US007874241B2

(12) United States Patent
Natili, Jr. et al.

(10) Patent No.: US 7,874,241 B2
(45) Date of Patent: Jan. 25, 2011

(54) ELECTRONICALLY CONTROLLABLE AND TESTABLE TURBINE TRIP SYSTEM

(75) Inventors: Richard Peter Natili, Jr., Cecil, PA (US); Thomas Sweeney, Verona, PA (US)

(73) Assignee: Emerson Process Management Power & Water Solutions, Inc., Pittsburgh, PA (US)

( * ) Notice: Subject to any disclaimer, the term of this patent is extended or adjusted under 35 U.S.C. 154(b) by 846 days.

(21) Appl. No.: 11/108,930

(22) Filed: Apr. 19, 2005

(65) Prior Publication Data

US 2006/0230755 A1 Oct. 19, 2006

(51) Int. Cl.
*F15B 11/08* (2006.01)

(52) U.S. Cl. ..... 91/448; 91/449; 91/454

(58) Field of Classification Search ..... 91/448, 91/449, 454; 60/406; 137/487.5
See application file for complete search history.

(56) References Cited

U.S. PATENT DOCUMENTS 4,343,454 A 8/1982 Kure-Jensen et al.
4,464,577 A 8/1984 Wagner et al.

(Continued)

FOREIGN PATENT DOCUMENTS

DE 3138562 4/1983
EP 0641919 3/1995

(Continued)

OTHER PUBLICATIONS

Ronald Hitzel et al., "Retrofitting Steam Turbines With Modem Control Platforms," Siemens Westinghouse PowerGEN 2003—Las Vegas, Nevada Dec. 9-11.

(Continued)

*Primary Examiner*—F. Daniel Lopez
(74) *Attorney, Agent, or Firm*—Marshall, Gerstein & Borun LLP

(57) ABSTRACT

A tripping control system for use with, for example, turbines, includes a block circuit having two or more redundant blocking valves disposed or connected in series within a pressure supply line to block the supply of hydraulic fluid within the pressure supply line and a bleed circuit having two or more bleed valves connected in parallel between the pressure supply line and a return or dump line to bleed to the hydraulic fluid from the pressure supply line. The blocking valves and the bleed valves are actuated by one or more control valves under the control of a process or safety controller which trips the turbine by first performing a bleed function using the bleed valves, which then causes the block function to automatically actuate. Pressure sensors disposed at various locations in the tripping control system provide feedback to the controller to enable the controller to test each of the block and bleed valves individually, during operation of the turbine, without causing an actual trip of the turbine. The tripping control system thereby provides reliable trip operation during a trip by providing redundant block and bleed functionality in combination with enabling the individual components of the block and bleed circuits to be tested while the turbine is online and operating but without preventing the turbine from being tripped, if necessary, during the test.

45 Claims, 8 Drawing Sheets

U.S. PATENT DOCUMENTS

| | | | | |
|---|---|---|---|---|
| 4,474,013 | A | 10/1984 | Chamberlain | |
| 4,585,205 | A | 4/1986 | Coppola et al. | |
| 4,929,148 | A | 5/1990 | Nutter | |
| 5,211,196 | A * | 5/1993 | Schwelm | 91/454 |
| 5,346,360 | A | 9/1994 | Cooper | |
| 5,561,976 | A | 10/1996 | Chu et al. | |
| 5,813,226 | A * | 9/1998 | Krone et al. | 91/454 |
| 6,691,604 | B1 * | 2/2004 | Hajek et al. | 91/454 |
| 6,830,067 | B2 | 12/2004 | Hayashi | |

OTHER PUBLICATIONS

Gerhard J. Weiss, "Electronic Overspeed Turbine Protection Without Real Overspeed Test—Valve Test With Single Valve Arrangement," Proceedings of 2000 International Joint Power Generation Conference, Miami Beach, Florida, Jul. 23-26, 2000.

"Emergency Tripping System: Using Hydraulic Trip-Reset Pilots Tandem with Trip Anticipator," General Electric, Nov.1968.

* cited by examiner

ELECTRONICALLY CONTROLLABLE AND TESTABLE TURBINE TRIP SYSTEM

TECHNICAL FIELD

The present disclosure relates generally to an electronically controllable and testable trip system for use with, for example, a turbine and, more particularly, to an apparatus and method for controlling and testing turbine trip control components while a turbine is operating in a manner that does not prevent the turbine from being tripped during the test.

BACKGROUND

Hydraulic control systems are commonly used to control power generation machines, such as turbines. Known hydraulic control systems may include a trip control system or other protection system configured to stop the turbine (i.e., trip the turbine) upon the detection of an abnormal operating condition or other system malfunction. Unfortunately, the failure of one or more components associated with the trip control system to operate properly can prevent a turbine trip operation from occurring during emergency situations, which can lead to extensive damage to the turbine as well as other catastrophes, such as harm or injury to plant personnel.

Existing emergency tripping systems such as, for example, the mechanical emergency tripping system manufactured by General Electric Company (GE), include several components (e.g., valves, governors, blocks, ports, etc.) piped together to form a mechanically operated trip system. In a purely mechanical version, block and bleed functions are performed using non-redundant hydraulically actuated valves. However, in some cases, this system has been retrofit to include electronically controlled redundant bleed valves that perform a bleed operation to dump or remove pressure from a steam valve trip circuit that operates the turbine based on a two-out-of-three voting scheme. Once a bleed operation is performed, however, the GE mechanical tripping system requires that the delivery of hydraulic fluid to the control port of the steam valve be blocked. Such a mechanical system results in a large, complex design having separate parts that may be expensive to manufacture. Additionally, the GE mechanical tripping system requires an operator to manually perform tests of the blocking components. Still further, the mechanical nature of the blocking system of the GE mechanical tripping system requires that an operator travel to the site of the turbine, which is undesirable.

While automatic tripping systems have been developed in which the mechanical governor and associated linkages are replaced with a controller that automatically performs a trip operation, such automatic tripping systems typically include single, isolated valves or are limited to the bleed functionality of the tripping system. In particular, as described above with respect to the retrofit GE turbine system, it is known to use a set of three control valves connected to a controller to perform a two out of three voting scheme for performing a bleed function within a turbine trip control system. In this configuration, each of the control valves operates two DIN valves which are connected to one another in a manner that assures that, if two out of the three control valves are energized, a hydraulic path is created through a set of two of the DIN valves to cause pressure to be bled from the trip port of the steam valve that provides steam to the turbine. The loss of pressure at the trip port of the steam valve closes the steam valve and trips or halts the operation of the turbine. With this configuration, the failure of any one of the control valves will not prevent a trip operation from being performed when desired or required and likewise, will not cause a trip to occur when such a trip is not desired. Additionally, because of the two out of three voting scheme, the individual components of this bleed circuit can be tested while the turbine is in operation without causing a trip to occur.

Unfortunately, the block circuit or block portion of the tripping control system is an important part of the control circuit and, currently, there is no manner of being able to provide redundancy in the block circuit to assure proper operation of the block circuit if one of the components thereof fails, and no manner of electronically testing or operating the block circuit. In fact, currently, the block circuit of this known turbine trip control system must be operated manually, which is difficult to do as it requires an operator to go to and actually manually operate components of the block circuit (generally located near the turbine) after the bleed portion of the trip operation has occurred. Likewise, because of the manually operated components, there is no simple remote manner of testing the operation of the block portion of the trip control system.

SUMMARY

A tripping control system for use with, for example, turbines, includes a block circuit having two or more redundant blocking valves connected in series within a pressure supply line to block the supply of hydraulic fluid within the pressure supply line and a bleed circuit having two or more bleed valves connected in parallel between the trip line and a return or dump line to bleed to the hydraulic fluid from the trip. The blocking valves and the bleed valves are actuated by one or more control valves under control of a process or safety controller which operates to cause a trip by first performing a bleed function using at least one of the bleed valves and then a block function using at least one of the blocking valves. Additionally, pressure sensors are disposed at various locations within the tripping control system and provide feedback to the controller to enable the controller to test each of the blocking and bleed valves individually, during operation of the turbine, without causing an actual trip of the turbine. In this manner, the tripping control system provides reliable trip operation by providing redundant block and bleed functionality in combination with enabling the individual components of the block and bleed circuits to be tested while the turbine is online and operating but without preventing the turbine from being tripped, if necessary, during the test. Additionally, the tripping control circuit can be integrated into a small, single package that can be easily fit onto existing turbine systems, thereby enabling existing turbine trip control systems to be retrofit or upgraded relatively inexpensively.

BRIEF DESCRIPTION OF THE DRAWINGS

1 are hydraulically coupled together through a manifold to form an integrated electronically controlled, hydraulic trip assembly.

DETAILED DESCRIPTION

Figure 1:
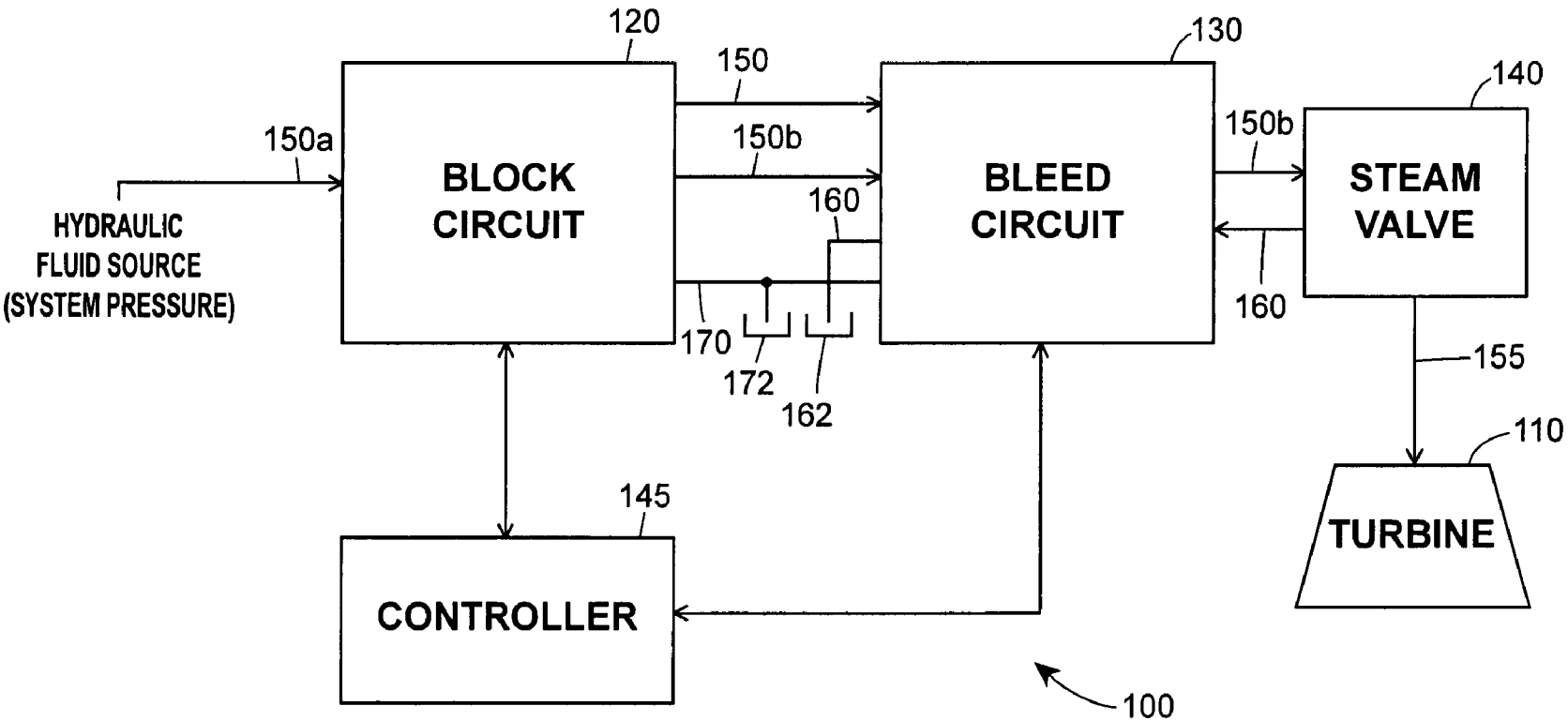
FIG. 1 is a functional block diagram of an embodiment of a hydraulic control system for a turbine including a bleed circuit and a block circuit.

Referring to FIG. 1, a tripping control system 100 for use with a turbine 110 includes a block circuit 120 that provides internally (automatically) actuated and testable block functionality in combination with a bleed circuit 130 that provides electronically actuated and testable bleed functionality and which, together, control the operation of a steam valve 140 to provide reliable trip operation for the turbine 110 during a safety trip. Generally speaking, the block circuit 120 and the bleed circuit 130 include redundant blocking and bleed functionality that enables the components of the block circuit 120 and the bleed circuit 130 to be tested while the turbine 110 is online and operating and in a manner that does not prevent a tripping action during the testing of any of the components of the block circuit 120 or the bleed circuit 130. Furthermore, the block circuit 120 and the bleed circuit 130 can be integrated into a small, single package that can be easily fit onto existing turbine trip control systems to enable such existing systems to be retrofit with the enhanced redundant and testable block and bleed functionality described herein.

As will be understood from FIG. 1, a line 150 supplies hydraulic fluid from a fluid or pressure source (not shown) through the block circuit 120, and the bleed circuit 130 to generally provide control pressure to individual valves within these circuits. Additionally, a line 150*a* is connected to the hydraulic fluid source upstream of the block circuit 120 and supplies hydraulic fluid to a line 150*b* downstream of the block circuit 120 depending on the operation of the block circuit 120. The line 150*b* flows through the bleed circuit 130 to a control input (trip) of the steam valve 140 to control the operation of the steam valve 140. Generally speaking, pressure over a certain amount within the line 150*b* at the input of the steam valve 140 causes the steam valve 140 to remain open, which allows steam to enter the turbine 110 via the line 155 thereby allowing or causing operation of the turbine 110. Additionally, a return hydraulic or pressure line 160, which is a low pressure fluid line, is coupled from the steam valve 140 through the bleed circuit 130 to a return reservoir 162 while a drain line 170, which is also a low pressure fluid line, connects the bleed circuit 130 and the block circuit 120 to a hydraulic fluid drain 172. If desired, the fluid drain 172 and the return reservoir 162 may be the same reservoir commonly referred to as a tank, and thus the low pressure fluid lines 160 and 170 may be hydraulically coupled together via the tank.

As illustrated in FIG. 1, a controller 145, which may be a safety controller, a process controller or any other desired type of controller and which may be implemented using distributed control system DSC technology, PLC technology, or any other type of control technology, is operatively coupled to each of the block circuit 120 and the bleed circuit 130. During operation, the controller 145 is configured to automatically operate the bleed circuit 130 thus causing the block circuit 120 to close automatically via the loss of pressure in the pilot passage from the trip pressure line 150*b* to cause a trip of the turbine 110. Additionally, the controller 145 is configured to receive pressure measurements from the block circuit 120 and the bleed circuit 130, which enables the controller 145 to perform tests of the individual components of the block circuit 120 and the bleed circuit 130 to thereby test the operation of the components of these circuits.

It should be understood that the controller 145 may be remote from or local to the block circuit 120 and the bleed circuit 130. Furthermore, the controller 145 may include a single control unit that operates and tests the block circuit 120 and the bleed circuit 130 or multiple control units, such as distributed control units, which are each configured to operate different ones of the block circuit 120 and the bleed circuit 130. Generally speaking, the structure and configuration of the controller 145 are conventional and, therefore, are not discussed further herein.

During normal operation of the turbine 110, which may be configured to drive a generator, for example, hydraulic fluid under pressure (e.g., operating oil) is supplied from a hydraulic fluid source (e.g., a pump) to the block circuit 120 and the bleed circuit 130 via the line 150, and to the steam valve 140 via the hydraulic fluid path made up of the lines 150*a* and 150*b*. The hydraulic fluid may include any suitable type of hydraulic material that is capable of flowing along the hydraulic fluid paths 150, 150*a* and 150*b* as well as the return path 160 and drain line 170. As noted above, when the pressure in the fluid line 150*b* at the trip input to the steam valve 140 is at a predetermined system pressure, the steam valve 140 allows or enables the flow of steam to the turbine 110. However, when the pressure in the fluid line 150*b* at the trip input of the steam valve 140 drops to a predetermined or significant amount below system pressure, the steam valve 140 closes, which causes a shutdown of the turbine 110.

Generally speaking, to cause a trip of the turbine 110, the controller 145 first operates the bleed circuit 130 to bleed fluid from the supply line 150*b* at the trip input of the steam valve 140 to the return line 160 to thereby remove the system pressure from the trip input of the steam valve 140 and cause a trip of the turbine 110. Once a trip of the turbine 110 has occurred, the block circuit 120 automatically operates due to the loss of trip pressure 150*b* to block the flow of hydraulic fluid within the supply line 150*a* to prevent continuous supply of hydraulic fluid from the supply line 150*a* to 150*b* while the turbine 110 is in a trip state. Additionally, as will be discussed in more detail, the controller 145 may control various components of the bleed circuit 130 and the block circuit 120 during normal operation of the turbine 110 to test those components without causing a trip of the turbine 110. This testing functionality enables the components of the trip system 100 to be periodically tested, and replaced if necessary, during operation of the turbine 110 without requiring the turbine 110 to be shut down or taken off line. This testing functionality also enables failed components of the block and bleed circuits 120 and 130 to be detected and replaced or repaired prior to the actual operation of a trip, thereby helping to assure reliable trip operation when needed.

In one embodiment, the controller 145 operates the bleed circuit 130 to perform a trip of the turbine 110 in response to the detection of one or more abnormal conditions or malfunctions within the plant in which the turbine 110 is located. To help ensure that a trip operation is performed even if one or more components associated with the bleed circuit 130 fail to operate properly, the bleed circuit 130 preferably includes a plurality of redundant valve systems that create redundant bleed fluid paths connected in parallel between the line 150*b* and the return line 160, wherein operation of any one of the parallel bleed fluid paths is sufficient to remove trip pressure from the trip input of the steam valve 140 and thereby cause a trip of the turbine 110. In one embodiment, the bleed circuit 130 may include three such valve systems, and each of the valve systems may include an actuator valve that controls two trip valves. In this case, as will be described in more detail with respect to FIG. 2, operation of two or more of the valve systems causes at least one bleed fluid path to be created between the line 150*b* and the return line 160, while operation of only one of the valve systems does not create a bleed path between the line 150*b* and the return path 160. This configuration is known as a two out of three voting system, and assures that a malfunction of a single one of the valve systems can not cause a trip when the control system 145 is not trying to initiate a trip, while also assuring that a malfunction of a single one of the valve systems will not prevent a trip from occurring when the controller 145 is trying to initiate a trip.

Figure 2:
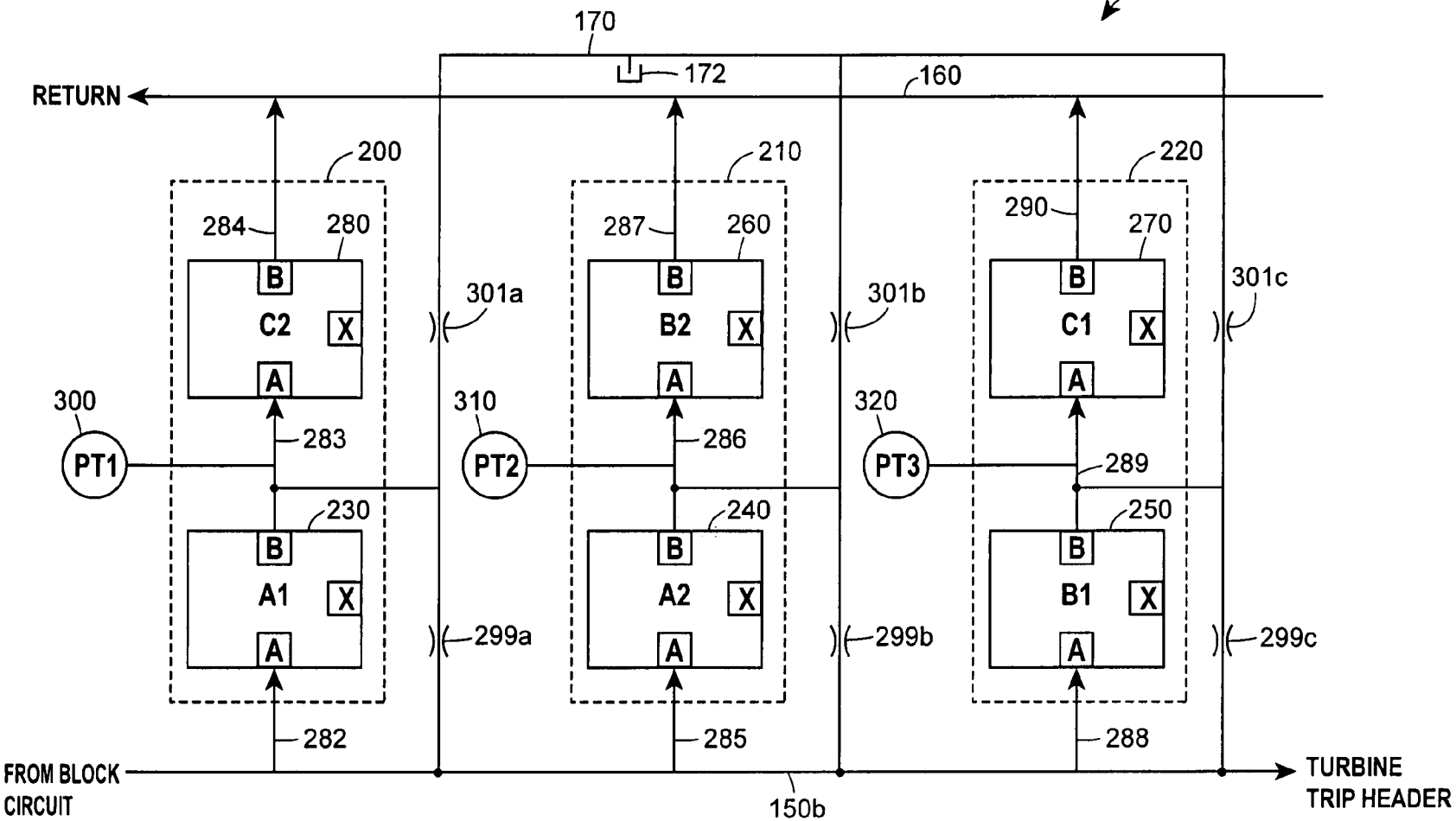
FIG. 2 is a functional block diagram of an embodiment of the bleed circuit shown in FIG. 1.

FIG. 2 illustrates a functional block diagram of one embodiment of the bleed circuit 130 of FIG. 1 in more detail. In particular, the bleed circuit 130 includes a plurality of redundant trip branches 200, 210 and 220 through which hydraulic fluid may flow from the hydraulic fluid path 150*b* to the return path 160 during a trip operation, thereby removing or bleeding pressure from the line 150*b* at the trip input of the steam valve 140 to stop operation of the turbine 110. As indicated in FIG. 2, each of the trip branches 200-220 includes two valves 230 and 280, 240 and 260, or 250 and 270 and, when both trip valves of a single branch are open, a bleed path is created and hydraulic fluid is permitted to flow from the hydraulic fluid path 150*b* to the return path 160. However, when either of the two valves of a single branch 200-220 is closed, hydraulic fluid is blocked or prevented from flowing from the hydraulic fluid path 150*b* to the return path 160 through that branch. As can be seen from FIG. 2, the plurality of trip valves 230-280 includes a first trip valve (A1) 230, a second trip valve (A2) 240, a third trip valve (B1) 250, a fourth trip valve (B2) 260, a fifth trip valve (C1) 270, and a sixth trip valve (C2) 280.

In one embodiment, each of the first-sixth trip valves 230-280 may be a two-way DIN cartridge valve having a pair of operational ports (A, B) and a control port (X) in which the operational ports (A, B) may be normally biased in an open position by a spring or other mechanical device (not shown). Hydraulic fluid may pass through the operational ports (A, B) of the trip valves 230-280 in response to the loss of control pressure at the control port (X). DIN cartridge valves are well known in the art and are, therefore, not described in further detail herein. In any event, as will be understood, when any of the trip valves 230-280 is in the open position, hydraulic fluid may flow from port A to port B of that valve. To the contrary, when control pressure is applied at the control port (X) of any of the trip valves 230-280, the trip valve 230-280 to which control pressure is provided locks the valve in a closed position to thereby block or prevent the flow of hydraulic fluid between the operational ports (A, B) of that valve.

As shown in FIG. 2, the first trip branch 200 includes the first trip valve (A1) 230 and the sixth trip valve (C2) 280 coupled between the hydraulic fluid path 150*b* and the return path 160. Specifically, port A of the first trip valve (A1) 230 is hydraulically coupled to the hydraulic fluid path 150*b* via hydraulic conduit 282, port B of the first trip valve (A1) 230 is hydraulically coupled to port A of the sixth trip valve (C2) 280 via hydraulic conduit 283, and port B of the sixth trip valve (C2) 280 is hydraulically coupled to the return path 160 via hydraulic conduit 284.

As is evident in FIG. 2, the second trip branch 210 includes the second trip valve (A2) 240 and the fourth trip valve (B2) 260 coupled between the hydraulic fluid path 150*b* and the return path 160. Specifically, port A of the second trip valve (A2) 240 is hydraulically coupled to the hydraulic fluid path 150*b* via hydraulic conduit 285, port B of the second trip valve (A2) 240 is hydraulically coupled to port A of the fourth trip valve (B2) 260 via hydraulic conduit 286, and port B of the fourth trip valve (B2) 260 is hydraulically coupled to the return path 160 via hydraulic conduit 287.

Still further, the third trip branch 220 includes the third trip valve (B1) 250 and the fifth trip valve (C1) 270 coupled between the hydraulic fluid path 150*b* and the return path 160. Specifically, port A of the third trip valve (B1) 250 is hydraulically coupled to the hydraulic fluid path 150*b* via hydraulic conduit 288, port B of the third trip valve (B1) 250 is hydraulically coupled to port A of the fifth trip valve (C1) 270 via hydraulic conduit 289, and port B of the fifth trip valve (C1) 270 is hydraulically coupled to the return path 160 via hydraulic conduit 290.

Figure 3:
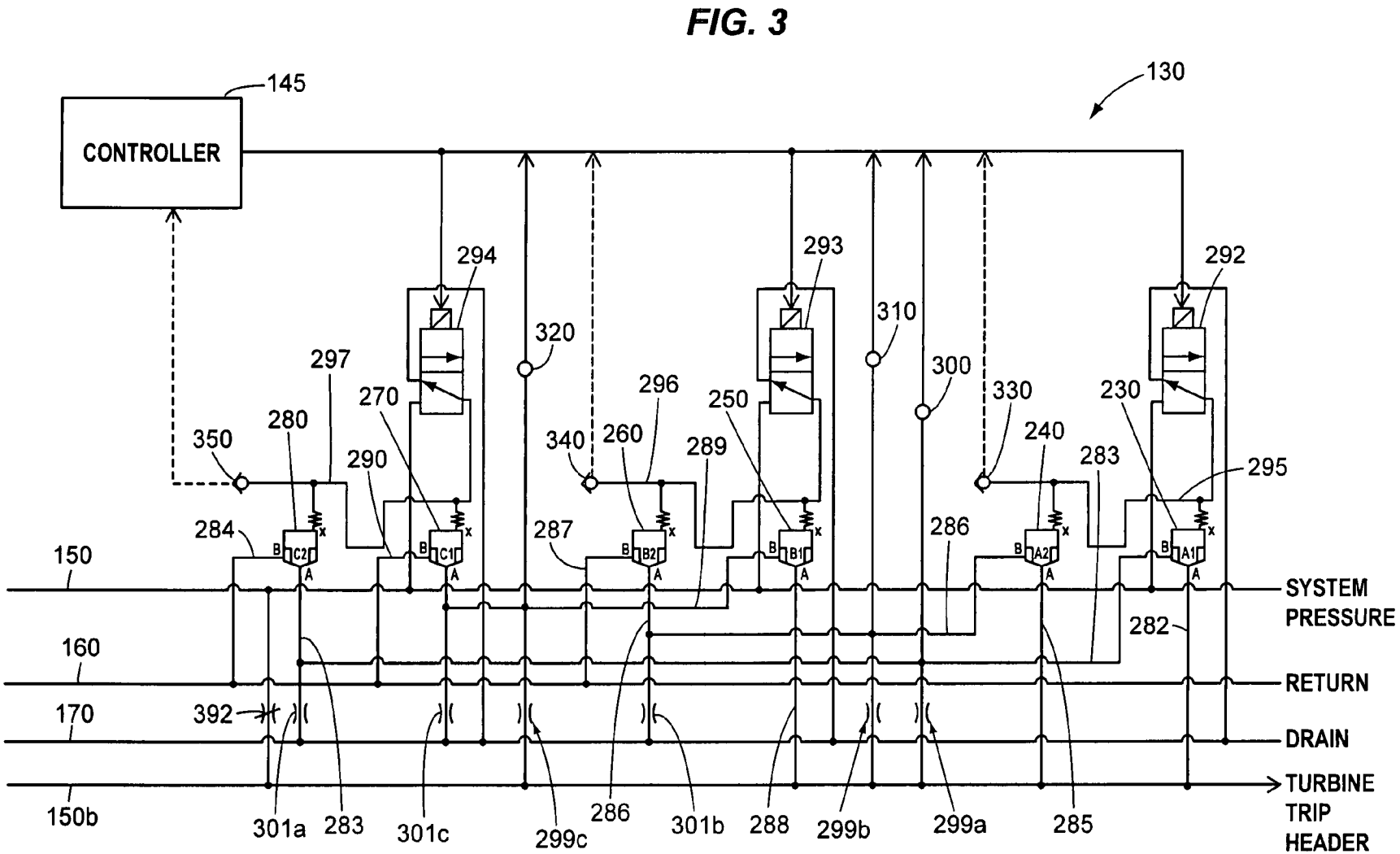
FIG. 3 is a more detailed schematic diagram of an embodiment of the bleed circuit shown in FIGS. 1 and 2.

For the sake of illustration, the control valves that control the operation of the trip valves 230-280 are not depicted in FIG. 2. However, it will be understood that a single control valve or actuator controls the operation of each of a pair of the trip valves 230-280 and, in particular, a first actuator simultaneously controls the operation of the valves A1 and A2 (230, 240), a second actuator simultaneously controls the operation of the valves B1 and B2 (250, 260), and a third actuator simultaneously controls the operation of the valves C1 and C2 (270, 280). FIG. 3 illustrates an example schematic diagram depicting one manner of implementing the bleed circuit depicted in FIG. 2 in which the first-sixth trip valves (A1, A2, B1, B2, C1, C2) 230-280 are connected between the hydraulic fluid line 150*b* and the return line 160 in an actual turbine trip system. As best illustrated in FIG. 3, the first actuator 292 is operatively coupled to a control port (X) of both the first trip valve (A1) 230 and the second trip valve (A2) 240 via hydraulic conduit 295 and simultaneously controls the application of control pressure at the control port (X) of both the first trip valve (A1) 230 and the second trip valve (A2) 240. When energized, the first actuator 292 is configured to activate both the first trip valve (A1) 230 and the second trip valve (A2) 240 to lock the first and second trip valves 230, 240 in their closed position. Similarly, the second actuator 293 is operatively coupled to a control port (X) of both the third trip valve (B1) 250 and the fourth trip valve (B2) 260 via hydraulic conduit 296 and controls the application of control pressure at the control port (X) of both the third trip valve (B1) 250 and the fourth trip valve (B2) 260. When energized, the second actuator 293 is configured to activate both the third trip valve (B1) 250 and the fourth trip valve (B2) 260 to lock the third and fourth trip valves 250, 260 in their closed position. Still further, the third actuator 294 is operatively coupled to a control port (X) of both the fifth trip valve (C1) 270 and the sixth trip valve (C2) 280 via hydraulic conduit 297 and controls the application of control pressure at the control port (X) of both the fifth trip valve (C1) 270 and the sixth trip valve (C2) 280. When energized, the third actuator 294 is configured to activate both the fifth trip valve (C1) 270 and the sixth trip valve (C2) 280 to lock the fifth and sixth trip valves 270, 280 in their closed position.

As will be understood, each of the first, second, and third actuators 292-294 is operatively coupled to the controller 145, which is configured to energize and de-energize each of the first, second, and third actuators 292-294, either separately or simultaneously. In one embodiment, each of the first, second, and third actuators 292-294 may include a solenoid valve that, when energized by the controller 145, supplies control pressure from the system pressure line 150 to the control port (X) of the associated trip valves 230-280 to lock the associated trip valves 230-280 in their closed position. Likewise, when de-energized by the controller 145, the first, second and third actuators 292-294 connect the control port (X) of the associated trip valves 230-280 to the drain line 170.

As depicted in FIGS. 2-3, the bleed circuit 130 further includes a pressure reduction orifice 299*a* located between the hydraulic conduit 283 and the hydraulic fluid path 150*b*, a pressure reduction orifice 299*b* located between the hydraulic conduit 286 and the hydraulic fluid path 150*b*, and a pressure reduction orifice 299*c* located between the hydraulic conduit 289 and the hydraulic fluid path 150*b*. Additionally, the bleed circuit 130 includes a pressure reduction orifice 301*a* located between the hydraulic conduit 283 and the bleed line 170, a pressure reduction orifice 301*b* located between the hydraulic conduit 286 and the bleed line 170, and a pressure reduction orifice 301*c* located between the hydraulic conduit 289 and the bleed line 170. During normal operating conditions when all of the first-sixth trip valves (A1, A2, B1, B2, C1, C2) 230-280 are in the closed position, the pressure in the hydraulic conduit 283, the pressure in the hydraulic conduit 286, and the pressure in the hydraulic conduit 289 are all maintained at a reduced pressure that is less than trip pressure (i.e., the pressure within the line 150*b*) but at a pressure above zero, with the amount or value of the fluid pressure being based on the size and configuration of the orifices 299*a*-299*c* and 301*a*-301*c*. Generally speaking, the orifices 299*a*-299*c* are sized to permit a gradual flow of fluid from the line 150*b* into the conduits 283, 286 and 289 while the orifices 301*a*-301*c* are sized to permit a gradual flow of fluid out of the conduits 283, 286 and 289 when the pressure in the conduits 283, 286 and 289 reaches a predetermined amount (which will be a pressure less then the pressure in the line 150*b*, such as at about half of the system pressure in the line 150*b*). In one embodiment, the orifices 299*a*-299*c* and 301*a*-301*c* may be approximately 0.031 inches in diameter, although other sizes may be used if desired. The purpose of providing the reduced fluid pressure in the conduits 283, 286 and 289 will be described in more detail in the following discussion.

To ensure that all of the components work properly to perform a trip operation when required or desired, the components associated with the bleed circuit 130 may be tested while the turbine 110 is operating online without interrupting operation of the turbine 110. For testing purposes, the bleed circuit 130 includes first, second, and third pressure transmitters (PT1-PT3) 300-320 configured to sense the pressure at the first, second, and third trip branches 200-220, respectively, and, in particular, to sense the fluid pressure in the conduits 283, 286 and 289 respectively. Additionally, the bleed circuit 130 may include first, second, and third pressure sensors (PS1-PS3) 330-350 configured to sense the fluid pressure in hydraulic conduits 295-297, respectively. As shown in FIG. 3, the first pressure sensor (PS1) 330 is configured to sense the fluid pressure in the hydraulic conduit 295 which couples the first actuator 292 to the control port (X) of both the first trip valve (A1) 230 and the second trip valve (A2) 240, the second pressure sensor (PS2) 340 is configured to sense the fluid pressure in the hydraulic conduit 296 that couples the second actuator 293 to the control port (X) of both the third trip valve (B1) 250 and the fourth trip valve (B2) 260, and the third pressure sensor (PS3) 350 is configured to sense the fluid pressure in a hydraulic conduit 297 that couples the third actuator 294 to the control port (X) of both the fifth trip valve (C1) 270 and the sixth trip valve (C2) 280. If desired, the pressure sensors 330, 340 and 350 may be connected the controller 145 although they need not be. As a result, the connections between the pressure sensors 330, 340 and 350 and the controller 145 are illustrated as dotted lines in FIG. 3. As will be described in greater detail below, the operation of the components associated with each of the plurality of redundant valve systems or branches 200-220 may be tested by monitoring the fluid pressure in each of the hydraulic conduits 283, 286, 289 and, if desired, 295, 296, 297.

During normal operating conditions (i.e., when the turbine 110 is not tripped), the controller 145 is configured to simultaneously energize each of the first, second, and third actuators 292-294 to activate the first-sixth trip valves (A1, A2, B1, B2, C1, C2) 230-280. When the first, second, and third actuators 292-294 are energized, control pressure is supplied at the control port (X) of each of the first-sixth trip valves (A1, A2, B1, B2, C1, C2) 230-280, thereby causing the first-sixth trip valves (A1, A2, B1, B2, C1, C2) 230-280 to lock the valve in the closed position. When the first-sixth trip valves (A1, A2, B1, B2, C1, C2) 230-280 are in the closed position, hydraulic fluid is blocked or prevented from flowing between the operational ports (A, B) of those valves and, as a result, no direct path exists between the hydraulic fluid path 150*b* and the return path 160. This configuration maintains sufficient hydraulic pressure within the hydraulic fluid path 150*b* at the trip input of the steam valve 140 to hold the steam valve 140 in the open position. When the steam valve 140 is held in the open position, steam is delivered to the turbine 110 and the turbine 110 operates normally.

During abnormal conditions or malfunctions, it may be desirable to stop operation of the turbine 110 to prevent damage to the turbine 110 and/or to prevent other catastrophes. To do so, the controller 145 creates a bleed fluid path between the hydraulic fluid path 150*b* and the return path 160 to thereby remove hydraulic pressure from the hydraulic fluid path 150*b*. The bleeding of pressure from the fluid path 150*b* causes the trip input of the steam valve 140 to become depressurized, thereby moving the steam valve 140 to the closed position and preventing the delivery of steam to the turbine 110. This action causes and is referred to as a tripping or halting of the turbine 110.

To determine if a trip is needed, the controller 145 may monitor turbine parameters such as, for example, turbine speed, turbine load, vacuum pressure, bearing oil pressure, thrust oil pressure, and the like using various sensors (not shown). As will be understood, the controller 145 may be configured to receive information from these sensors during operation of the turbine 110 to monitor operating conditions of the turbine 110, to thereby detect abnormal operating conditions and problems associated with the turbine 110 that may require that the turbine 110 be shut down. In response to information received from the operational sensors such as, for example, the detection of an overspeed condition, the controller 145 may cause a trip operation to be performed. To actually effectuate such a trip, the components associated with only two of the redundant valve systems or branches 200-220 of the bleed circuit 130 need to operate properly. However, to cause a trip, the controller 145 will generally operate (actually deactivate) each of the actuators 292, 293 and 294 to thereby attempt to open each of the trip valves (A1, A2, B1, B2, C1, C2) 230-280 and create three parallel bleed fluid paths between the hydraulic fluid line 150*b* and the return path 160. In this manner, the trip control system helps to assure that a trip will be performed even if one of the components of the bleed circuit 130 fails to operate properly because, in that case, at least one bleed fluid path will still be created or opened between the hydraulic fluid path 150*b* and the return path 160, thus causing a trip.

More particularly, during a trip operation, the controller 145 may be configured to simultaneously de-energize each of the first, second, and third actuators 292-294 so that hydraulic fluid is permitted to flow through each of the first trip branch 200, the second trip branch 210, and the third trip branch 220, thereby dumping pressure off the trip input of the steam valve 140 to stop operation of the turbine 110. As will be understood from FIG. 3, when the controller 145 de-energizes the first actuator 292, the control ports (X) of both the first trip valve (A1) 230 and the second trip valve (A2) 240 are coupled through the actuator 292 to the drain 170. As a result, control or system pressure from the line 150 is released or removed from each of the control ports (X) of the first trip valve (A1) 230 and the second trip valve (A2) 240, and the pressure within the control line for these valves is diverted or bled to the drain 170. When control pressure at the control ports (X) of the first trip valve (A1) 230 and the second trip valve (A2) 240 is bled to the drain 170, both of the first trip valve (A1) 230 and the second trip valve (A2) 240 move from the closed position to the open position and hydraulic fluid is permitted to flow through the operational ports (A, B) of the first trip valve (A1) 230 and the second trip valve (A2) 240.

Similarly, when the controller 145 de-energizes the second actuator 293, the control ports (X) of both the third trip valve (B1) 250 and the fourth trip valve (B2) 260 are coupled through the actuator 293 to the drain 170. As a result, control or system pressure from the line 150 is released or removed at each of the control ports (X) of the third trip valve (B1) 250 and the fourth trip valve (B2) 260, and the pressure within the control line for these valves is immediately diverted or bled to the drain 170. When control pressure at the control ports (X) of the third trip valve (B1) 250 and the fourth trip valve (B2) 260 is bled to the drain 170, both of the third trip valve (B1) 250 and the fourth trip valve (B2) 260 move from the closed position to the open position which enables hydraulic fluid to flow through the operational ports (A, B) of the third trip valve (B1) 250 and the fourth trip valve (B2) 260.

Likewise, when the controller 145 de-energizes the third actuator 294, the control ports (X) of both the fifth trip valve (C1) 270 and the sixth trip valve (C2) 280 are coupled through the actuator 294 to the drain 170. As a result, control or system pressure is released or removed at each of the control ports (X) of the fifth trip valve (C1) 270 and the sixth trip valve (C2) 280, and the pressure within the control line for these valves is immediately diverted or bled to the drain 170. When control pressure at the control ports (X) of the fifth trip valve (C1) 270 and the sixth trip valve (C2) 280 is bled to the drain 170, both of the fifth trip valve (C1) 270 and the sixth trip valve (C2) 280 move from the closed position to the open position which permits hydraulic fluid to flow through the operational ports (A, B) of the fifth trip valve (C1) 270 and the sixth trip valve (C2) 280.

As will be understood, to effectuate a trip operation, hydraulic fluid in the fluid path 150*b* need only flow to the return path 160 via one of the first, second, or third trip branches 200-220 to, thereby depressurize the trip input of the steam valve 140 and stop operation of the turbine 110. As a result, the components associated with only two of the redundant valve systems A1 and A2, B1 and B2 or C1 and C2 need to operate properly to perform a trip operation. In other words, if all of the components associated with the first valve system (e.g., the first actuator 292, the first trip valve (A1) 230, and the second trip valve (A2) 240) operate properly, and if all of the components associated with the third valve system (e.g., the third actuator 294, the fifth trip valve (C1) 270, and the sixth trip valve (C2) 280) operate properly, then hydraulic fluid may flow from the hydraulic fluid path 150*b* to the return path 160 via the first trip branch 200, thereby dumping trip pressure off the steam valve 140 and stopping operation of the turbine 110. Similarly, if all of the components associated with the first valve system operate properly, and if all of the components associated with the second valve system (e.g., the second actuator 293, the third trip valve (B1) 250, and the fourth trip valve (B2) 260) operate properly, then hydraulic fluid may flow from the hydraulic fluid path 150*b* to the return path 160 via the second trip branch 210, thereby dumping trip pressure off the steam valve 140 and stopping operation of the turbine 110. Still further, if all of the components associated with the second and the third valve systems operate properly, then hydraulic fluid may flow from the hydraulic fluid path 150*b* to the return path 160 via the third trip branch 220, thereby dumping trip pressure off the steam valve 140 and stopping operation of the turbine 110. In this manner, redundancy is achieved by requiring that the components associated with only two of the three valve systems operate properly to perform a trip operation. In other words, the failure of one or more components associated with one of the branches 200-220 will not prevent the controller 145 from performing a trip operation to stop the turbine 110.

Still further, it is desirable, from time to time, to test the components associated with the bleed circuit 130 while the turbine 110 is online and operating to ensure that all of these components work properly. However, it is desirable to test these components without interrupting the operation of the turbine 110, as stopping the turbine 110 for testing or maintenance is costly and undesirable. In the system illustrated in FIGS. 2 and 3, the controller 145 may remotely test the operation of each of the redundant valve branches 200-220 individually while the turbine 110 is online and operating. In particular, to perform a test, the controller 145 may actuate the actuators 292, 293 and 294 individually and monitor the pressure in one or more of the hydraulic conduits 283, 286, 289 and, if desired the conduits 295, 296, and 297, using the pressure transmitters 300, 310, 320, 330, 340, and 350 to determine if the components associated with the bleed circuit 130 are operating properly. In this manner, a human operator is not required to perform manual tests on the various valves (A1, A2, B1, B2, C1, C2) 230-280 and actuators 292-294, which requires that the turbine 110 be shut down. Moreover, when the controller 145 is testing the components associated with the bleed circuit 130, the controller 145 maintains the ability to stop operation of the turbine 110 (i.e., trip the turbine 110) upon the occurrence of an abnormal condition or malfunction to prevent damage to the turbine 110 and/or to prevent other catastrophes.

More specifically, to test the operation of the first actuator 292, the first trip valve (A1) 230, and the second trip valve (A2) 240 associated with the first valve system, the controller 145 de-energizes the first actuator 292 while keeping the second actuator 293 and the third actuator 294 energized. When the controller 145 de-energizes the first actuator 292, the control ports (X) of both the first trip valve (A1) 230 and the second trip valve (A2) 240 should be coupled to the drain 170 and thus control pressure should be released or removed from each of the control ports (X) of the first trip valve (A1) 230 and the second trip valve (A2) 240. Thus, if the first actuator 292 is operating properly, when the first actuator 292 is de-energized, both of the first trip valve (A1) 230 and the second trip valve (A2) 240 should move from the closed position to the open position. By monitoring the pressure sensed by the first pressure transmitter (PT1) 300. at the hydraulic conduit 283, the pressure sensed by the second pressure transmitter (PT2) 310 at the hydraulic conduit 286, and the pressure sensed by the third pressure transmitter (PT3) 320 at the hydraulic conduit 289, the controller 145 can determine whether one or more of the first actuator 292, the first trip valve (A1) 230, and the second trip valve (A2) 240 are operating properly.

In particular, if each of the first actuator 292, the first trip valve (A1) 230, and the second trip valve (A2) 240 is operating properly when the controller 145 de-energizes the first actuator 292, the third pressure transmitter (PT3) 320 should sense a small or negligible pressure change at the hydraulic conduit 289 that couples the third trip valve (B1) 250 to the fifth trip valve (C1) 270. Additionally, the first pressure transmitter (PT1) 300 should sense system pressure at the hydraulic conduit 283 when the controller 145 de-energizes the first actuator 292 due to the first trip valve (A1) 230 being in the open position and the sixth trip valve (C2) 280 being in the closed position. Still further, the second pressure transmitter (PT2) 310 should sense system pressure at the hydraulic conduit 286 when the controller 145 de-energizes the first actuator 292 due to the second trip valve (A2) 240 being in the open position and the fourth trip valve (B2) 260 being in the closed position.

If the third pressure transmitter (PT3) 320 senses a pressure other than a small or negligible pressure change at the hydraulic conduit 289 after the controller 145 de-energizes the first actuator 292, the controller 145, to the extent it receives a measurement from the pressure transmitter 320, may determine that the first actuator 292 is not operating properly, and generate a fault or alarm signal or take any other desired action to notify a user of the problem. Additionally, if the pressure transmitter (PT3) 320 senses a small or negligible pressure change but the first pressure transmitter (PT1) 300 senses a pressure other than system pressure at the hydraulic conduit 283 after the controller 145 de-energizes the first actuator 292, the controller 145 may determine that the first trip valve (A1) 230 is not operating properly, and generate a fault or alarm signal, if desired. In particular, if the first pressure transmitter (PT1) 300 senses a reduced pressure level that is less than system pressure at the hydraulic conduit 283 due to the orifice 299*a*, the controller 145 may determine that both the first trip valve (A1) 230 and the sixth trip valve (C2) 280 are in the closed position indicating that the first trip valve (A1) 230 has failed to operate properly. Still further, if the third pressure transmitter (PT3) 320 senses a small or negligible pressure change but the second pressure transmitter (PT2) 310 senses a pressure other than system pressure at the hydraulic conduit 286 after the controller 145 de-energizes the first actuator 292, the controller 145 may determine that the second trip valve (A2) 240 is not operating properly, and generate a fault or alarm signal, if desired.

The second actuator 293, the third trip valve (B1) 250, and the fourth trip valve (B2) 260 associated with the second valve system may be tested in a manner similar to the manner described above with respect to the first valve system. Specifically, when the controller 145 de-energizes the second actuator 293 while keeping the first actuator 292 and the third actuator 294 energized, the control ports (X) of both the third trip valve (B1) 250 and the fourth trip valve (B2) 260 should be coupled through the actuator 293 to the drain 170 and thus control or system pressure should be released or removed from each of the control ports (X) of the third trip valve (B1) 250 and the fourth trip valve (B2) 260. Thus, if the second valve system is operating properly when the actuator 293 is de-energized, both of the third trip valve (B1) 250 and the fourth trip valve (B2) 260 should move from the closed position to the open position. By monitoring the pressure sensed by the first pressure transmitter (PT1) 300 at the hydraulic conduit 283, the pressure sensed by the second pressure transmitter (PT2) 310 at the hydraulic conduit 286, and the pressure sensed by the third pressure transmitter (PT3) 320 at the hydraulic conduit 289, the controller 145 may determine whether one or more of the second actuator 293, the third trip valve (B1) 250, and the fourth trip valve (B2) 260 are operating properly.

In particular, if the second actuator 293, the third trip valve (B1) 250, and the fourth trip valve (B2) 260 are operating properly when the controller 145 de-energizes the second actuator 293, the first pressure transmitter (PT1) 300 should sense a small or negligible pressure change at the hydraulic conduit 283 that couples the first trip valve (A1) 230 to the sixth trip valve (C2) 280. Additionally, the second pressure transmitter (PT2) 310 should sense a small or negligible pressure in the hydraulic conduit 286 as operation of the fourth trip valve (B2) 210 should allow the reduced system pressure present in the hydraulic conduit 286 as a result of the operation of the orifices 299*b* and 301*b* to be dissipated via the now open trip valve (B2) 260 to the return path 160. Still further, the third pressure transmitter (PT3) 320 should sense system pressure in the hydraulic conduit 289 due to the third trip valve (B1) 250 being in the open position and the fifth trip valve (C1) 270 being in the closed position.

If the first pressure transmitter (PT1) 300 senses a pressure other than a small or negligible pressure change at the hydraulic conduit 283 after the controller 145 de-energizes the second actuator 293, the controller 145 may determine that the second actuator 293 is not operating properly, and generate a fault or alarm signal, or take any other desired action. Additionally, if the first pressure transmitter (PT1) 300 senses a small or negligible pressure change, but the second transmitter (PT2) 310 senses a pressure other than a small or negligible pressure at the hydraulic conduit 286, the controller 145 may determine that the fourth trip valve (B2) 260 is not operating properly, and generate a fault or alarm signal. In particular, in this case, if the second pressure transmitter (PT2) 310 senses a reduced system pressure that is greater than a small or negligible pressure in the hydraulic conduit 286, the controller 145 may determine that the fourth trip valve (B2) 260 remained in the closed position instead of opening and allowing the reduced system pressure present in the hydraulic conduit 286 as a result of the operation of the orifices 299*b* and 301*b* to be dissipated via the return path 160. Still further, if the first pressure transmitter (PT1) 300 senses a small or negligible pressure change, but the third pressure transmitter (PT3) 320 senses a pressure other than system pressure at the hydraulic conduit 289, the controller 145 may determine that the third trip valve (B1) 250 is not operating properly, and generate a fault or alarm signal.

The third actuator 294, the fifth trip valve (C1) 270, and the sixth trip valve (C2) 280 of the third valve system may be tested in a similar manner as the first valve system and the second valve system. Specifically, when the controller 145 de-energizes the third actuator 294 while keeping the first actuator 292 and the second actuator 293 energized, the control ports (X) of both the fifth trip valve (C1) 270 and the sixth trip valve (C2) 280 should be coupled to the drain 170 and control pressure should be released or removed from each of the control ports (X) of the fifth trip valve (C1) 270 and the sixth trip valve (C2) 280. Moreover, if the third actuator 294 is operating properly when de-energized by the controller 145, both of the fifth trip valve (C1) 270 and the sixth trip valve (C2) 280 should move from the closed position to the open position. By monitoring one or more of the pressures sensed by the second pressure transmitter (PT2) 310 at the hydraulic conduit 286, the pressure sensed by the first pressure transmitter (PT1) 300 at the hydraulic conduit 283, and the pressure sensed by the third pressure transmitter (PT3) 320 at the hydraulic conduit 289, the controller 145 may determine whether one or more of the third actuator 294, the fifth trip valve (C1) 270, and the sixth trip valve (C2) 280 are operating properly.

In particular, if each of the third actuator 294, the fifth trip valve (C1) 270, and the sixth trip valve (C2) 280 is operating properly when the controller 145 de-energizes the third actuator 294 while keeping the first actuator 292 and the second actuator 293 energized, the second pressure transmitter (PT2) 310 should sense a small or negligible pressure change at the hydraulic conduit 286 that couples the second trip valve (A2) 240 to the fourth trip valve (B2) 260. Additionally, the first pressure transmitter (PT1) 300 should sense a small or negligible pressure at the hydraulic conduit 283 due to the first trip valve (A1) 230 being in the closed position and the sixth trip valve (C2) 280 being in the open position, allowing the reduced system pressure developed in the conduit 283 by the orifices 299*a* and 301*a* to be dissipated to the return path 160 through the sixth trip valve (C2) 280. Still further, the third pressure transmitter (PT3) 320 should sense a small or negligible pressure at the hydraulic conduit 289 due to the third trip valve (B1) 250 being in the closed position and the fifth trip valve (C1) 270 being in the open position, allowing the reduced system pressure developed in the conduit 289 by the orifices 299*c* and 301*c* to be dissipated to the return path 160 through the fifth trip valve (C1) 270.

If the second pressure transmitter (PT2) 310 senses a pressure other than a small or negligible pressure change at the hydraulic conduit 286 after the controller 145 de-energizes the third actuator 294 while keeping the first actuator 292 and the second actuator 293 energized, the controller 145 may determine that the third actuator 294 is not operating properly, and generate a fault or alarm signal. Additionally, if the second pressure transmitter (PT2) 310 senses a small or negligible pressure change, but the first transmitter (PT1) 300 senses a pressure other than a small or negligible pressure at the hydraulic conduit 283 after the controller 145 de-energizes the third actuator 294, the controller 145 may determine that the sixth trip valve (C2) 280 is not operating properly, and generate a fault or alarm signal. Still further, if the second pressure transmitter (PT2) 310 senses a small or negligible pressure change, but the third pressure transmitter (PT3) 320 senses a pressure other than a small or negligible pressure at the hydraulic conduit 289 after the controller 145 de-energizes the third actuator 294, the controller 145 may determine that the fifth trip valve (C1) 270 is not operating properly, and generate a fault or alarm signal. Of course, if desired, the controller 145 may not receive signals from the pressure sensors PS1, PS2 and PS3 and may still diagnose a fault within or associated with the trip valves using the signals from the pressure transmitters PT1, PT2 and PT3 in the manner discussed above, with it being understood that if the controller detects that both valves associated with a particular actuator, such as valves A1 and A2, appear to be failing, the problem may be with the actuator which drives or controls those valves.

As can be seen, the operation of a trip of the turbine 110 is not prevented during the testing of any one of the valve systems associated with the actuators 292, 293 and 294 because, during a test, the controller 145 is essentially controlling one of the three valve systems to simulate a trip for that valve system. Thus, to actuate an actual trip during a test, the controller 145 need only send a trip signal to one or both of the other valve systems (not undergoing the test) by de-energizing one or both of the actuators 292, 293 or 294 associated with the other valve systems.

As will be understood, the bleed circuit 130 described above is configured to electronically perform a trip operation from a remote location in response to abnormal conditions or malfunctions by bleeding the hydraulic fluid in the hydraulic fluid path 150*b* to the return path 160 using a two out of three voting scheme, thereby removing pressure from the trip input of the steam valve 140. In addition, because of the two out of three redundancy, the components of this bleed circuit 130 can be tested individually during operation of the turbine 110, but without preventing the controller 145 from effectuating an actual trip during the test. As a result, a human operator is not required to manually operate or test the components associated with the bleed circuit 130. Furthermore, the plurality of redundant valve systems associated with the bleed circuit 130 described above helps to ensure that a trip operation can be performed even if one of the components associated with the bleed circuit fails to operate. As a result, the bleed circuit 130 described herein provides greater reliability that a trip operation will be performed when desired or required.

While not shown in FIGS. 2 and 3, manually operated valves, such as needle valves, may be disposed between the pressure transmitters 300, 310 and 320 and the lines to which these transmitters attach to, for example, enable these transmitters to be isolated from the fluid lines to allow these transmitters to be repaired or replaced. Still further, if desired, another valve, such as a manually operated needle valve 392, may be disposed between the line 150 which supplies system pressure to the bleed circuit 130 and the line 150*b* to enable a user to manually pressurize the line 150*b* at any desired time or to compensate for leakage in the line 150*b*.

Once the bleed circuit 130 of FIGS. 1-3 performs a bleed function to thereby initiate a trip of the turbine 110, it is desirable to prevent or block the flow of hydraulic fluid from the hydraulic fluid source to the turbine trip header while the turbine 110 is in the trip state. As illustrated in FIG. 1, the block circuit 120 is hydraulically located upstream from and is coupled to the bleed circuit 130 to perform the block function. In particular, the block circuit 120 operates to block the pressure line 150*b* from the hydraulic pressure source (not shown in the figures but located upstream of the block circuit 120), to prevent unnecessary cycling of hydraulic fluid through the pressure lines 150*a* and 150*b* and the return path 160 during a trip state of the turbine 110. The block circuit 120 operates automatically by sensing the loss of turbine trip header pressure 150*b*. If the block circuit 120 fails to adequately block system pressure to the turbine trip header after the bleed circuit 130 removes the pressure in the line 150*b*, the hydraulic pressure pump or source unnecessarily operates in an attempt to increase the pressure in the line 150*b* which, of course, cannot happen due to the operation of the bleed circuit 130 during the trip.

Preferably, the block circuit 120 includes redundancy to enable the block circuit 120 to work correctly in the presence of a failed component within the block circuit 120. Furthermore, the block circuit 120 is preferably remotely testable during operation of the turbine 110 in a manner that does not trip the turbine 110 but that enables the turbine 110 to be tripped, if necessary, during the testing of the block circuit 120. In one embodiment, the block circuit 120 may include a plurality of redundant blocking components connected in series within the hydraulic fluid line 150 and configured to block system pressure to the turbine trip header in a redundant manner after a trip has occurred.

Figure 4:
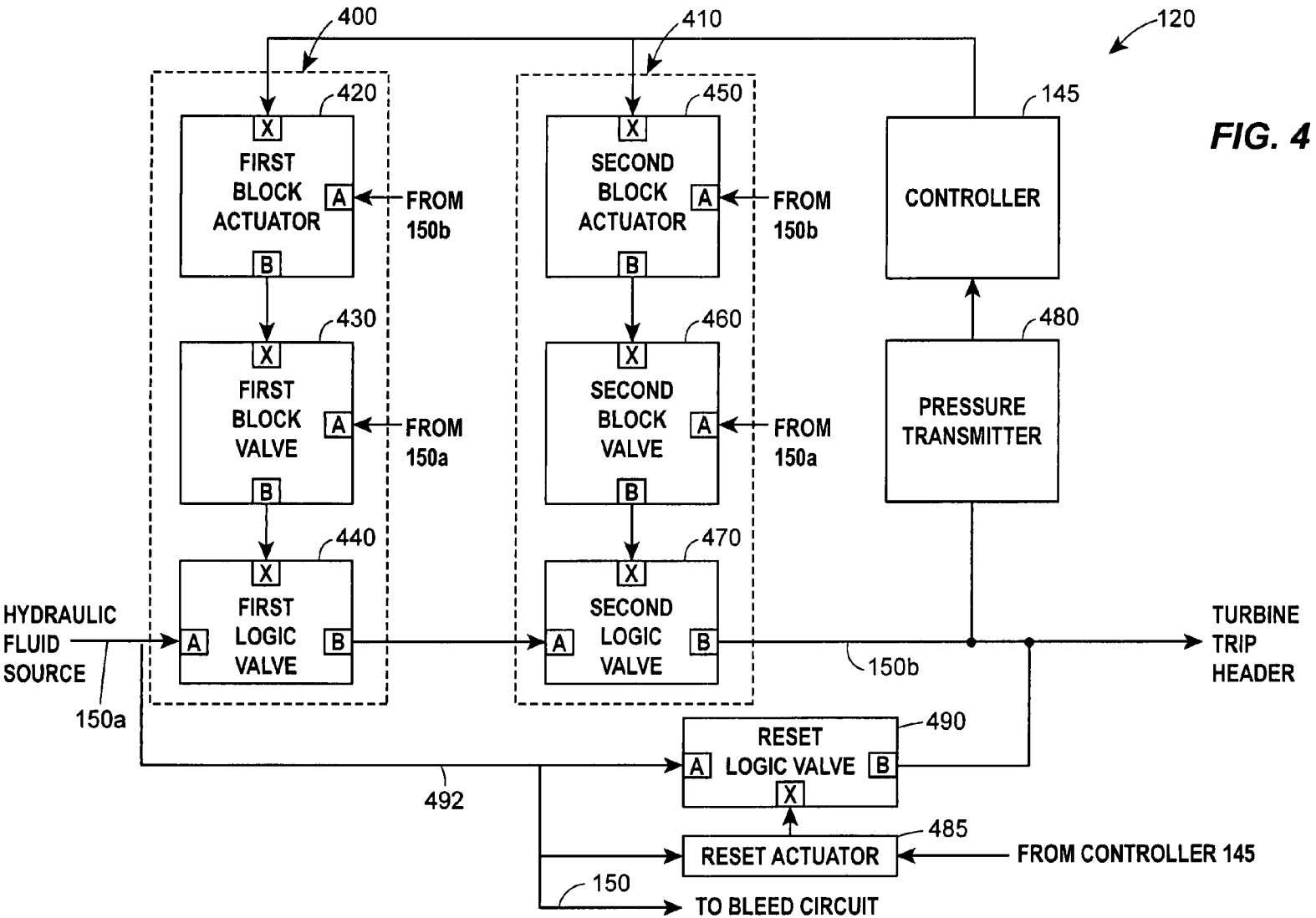
FIG. 4 is a functional block diagram of an embodiment of the block circuit shown in FIG. 1.

Referring to FIG. 4, the block circuit 120 may include a first blocking section 400 and a second blocking section 410, each having a valve 440 or 470 connected in series within the hydraulic fluid line 150*a* to divide the line 150*a* upstream of the block circuit 120 from the line 150*b* downstream of the block circuit 120. During a blocking operation, each of the first blocking section 400 and the second blocking section 410 is configured to block the flow of hydraulic fluid from the hydraulic fluid source to the turbine trip header by disconnecting or preventing fluid flow from the line 150*a* to the line 150*b*. As will be described in greater detail below, the first blocking section 400 and the second blocking section 410 operate redundantly with respect to one another so that operation of either of the first blocking section 400 or the second blocking section 410 prevents or blocks the flow of hydraulic fluid to the turbine trip header, i.e., blocks the upstream pressure line 150*a* from the downstream pressure line 150*b*. Because of this redundancy, the flow of hydraulic fluid may still be blocked by the block circuit 120 even if one of the first blocking section 400 or the second blocking section 410 fails to perform the blocking operation, which helps to provide reliable blocking functionality.

As illustrated in the functional diagram of FIG. 4, the first blocking section 400 includes a first block actuator 420, a first block valve 430 hydraulically coupled to the first block actuator 420, and a first logic valve 440 hydraulically coupled to the first block valve 430 and disposed within the hydraulic fluid path 150. The actuator 420 includes an electronic control port (X) which receives an electronic signal from the controller 145, a fluid input port (A) coupled to the downstream fluid line 150*b* and an output port (B) coupled to a hydraulic control port (X) of the first block valve 430. Likewise, the first block valve 430 includes a fluid input port (A) coupled to receive system pressure from the line 150*a* and an output port (B) coupled to the hydraulic control port (X) of the first logic valve 440 which has an input port (A) coupled to the line 150*a* and an output port (B) coupled to the second logic valve 470. As will be understood, the first block actuator 420 controls the application of downstream system pressure to the control input of the first block valve 430 and, in one embodiment, the first block actuator 420 includes a solenoid valve that, when de-energized by the controller 145, supplies downstream system pressure (i.e., pressure in the line 150*b*) to the control input of the first block valve 430. The first block valve 430 controls the movement of the first logic valve 440 between an open position and a closed position. The first logic valve 440 may be a two-way DIN cartridge valve, for example, having a pair of operational ports (A, B) and a control port (X). It should be understood, however, that the first logic valve 440 may be any other type of valve that may be operated in an open position or a closed position.

The first logic valve 440 is normally biased in an open position by a spring (not shown) or other mechanical device to allow the flow of hydraulic fluid from the hydraulic fluid source to the turbine trip header. Thus the logic valve 440 normally allows free flow from ports (A) to (B) or (B) to (A). Since the port (X) on the logic valve 440 connects directly to the line 150*a* through the first block valve 430, the logic valve 440 will not allow fluid flow from port (A) to port (B) (i.e., from the line 150*a* to the second logic valve 470), unless the pressure at the port (X) of the logic valve 440 is vented. When the first block valve 430 receives pressure from the line 150*b* through the first block actuator 420, then the logic valve 440 allows, because its (X) port is vented to the drain 170, fluid flow from port (A) to port (B) and on to the second logic valve 470. If the turbine trip header pressure in the line 150*b* is bled through the bleed circuit 130 (i.e., during an initiated trip), then the pressure at the port (X) of the first block valve 430 is also vented through the bleed circuit 130 thus causing the first block valve 430 to move to its spring biased position, which connects the port (X) of the logic valve 440 to the pressure line 150*a* thereby causing the logic valve 440 to close.

Similarly, the second blocking system 410 includes a second block actuator 450, a second block valve 460 hydraulically coupled to the second block actuator 450, and a second logic valve 470 hydraulically coupled to the second block valve 460 and disposed between the first logic valve 440 and the hydraulic fluid path 150. As illustrated in FIG. 4, the actuator 450 includes an electronic control port (X) which receives an electronic signal from the controller 145, a fluid input port (A) coupled to the downstream fluid line 150*b* and an output port (B) coupled to a hydraulic control port (X) of the second block valve 460. Likewise, the second block valve 460 includes a fluid input port (A) coupled to receive system pressure from the line 150*a* and an output port (B) coupled to the hydraulic control port (X) of the second logic valve 470 which has an input port (A) coupled to the output of the first logic valve 440 and an output port (B) coupled to the downstream line 150*b*. In this configuration, the second block actuator 450 controls the application of system pressure to the second block valve 460 and, in one embodiment, the second block actuator 450 includes a solenoid valve that, when de-energized by the controller 145, supplies downstream system pressure to the control input of the second block valve 460. The second block valve 460 controls the movement of the second logic valve 470 between an open position or a closed position. If desired, the second logic valve 470 may be a two-way DIN cartridge valve, for example. It should be understood, however, that the second logic valve 470 may be any other type of valve that may be operated to move between an open position and a closed position.

The second logic valve 470 is normally biased in the open position by a spring (not shown) or other mechanical device to allow the flow of hydraulic fluid from the hydraulic fluid source to the turbine trip Thus, the logic valve 470 normally allows free flow from the ports (A) to (B) or (B) to (A). Because the port (X) on the logic valve 470 connects directly to the line 150*a* through the second block valve 460, the logic valve 470 will not allow fluid flow from port (A) to port (B) (i.e., from the first logic valve 440 to the check valve 484), unless the pressure at the port (X) of the logic valve 470 is vented. When the second block valve 460 receives pressure from the line 150*b* through the second block actuator 450, then the logic valve 470 allows, because its (X) port is vented to the drain 170, fluid flow from port (A) to port (B) and on to the check valve 484. If the turbine trip header pressure 150*b* is bled through the bleed circuit 130 (i.e., during an initiated trip), then the pressure at the port (X) of the second block valve 460 is also vented through the bleed circuit 130 thus causing the second block valve 460 to move to its spring biased position, which connects port (X) of the logic valve 470 to the pressure line 150*a*, thereby causing the logic valve 470 to close.

Figure 5:
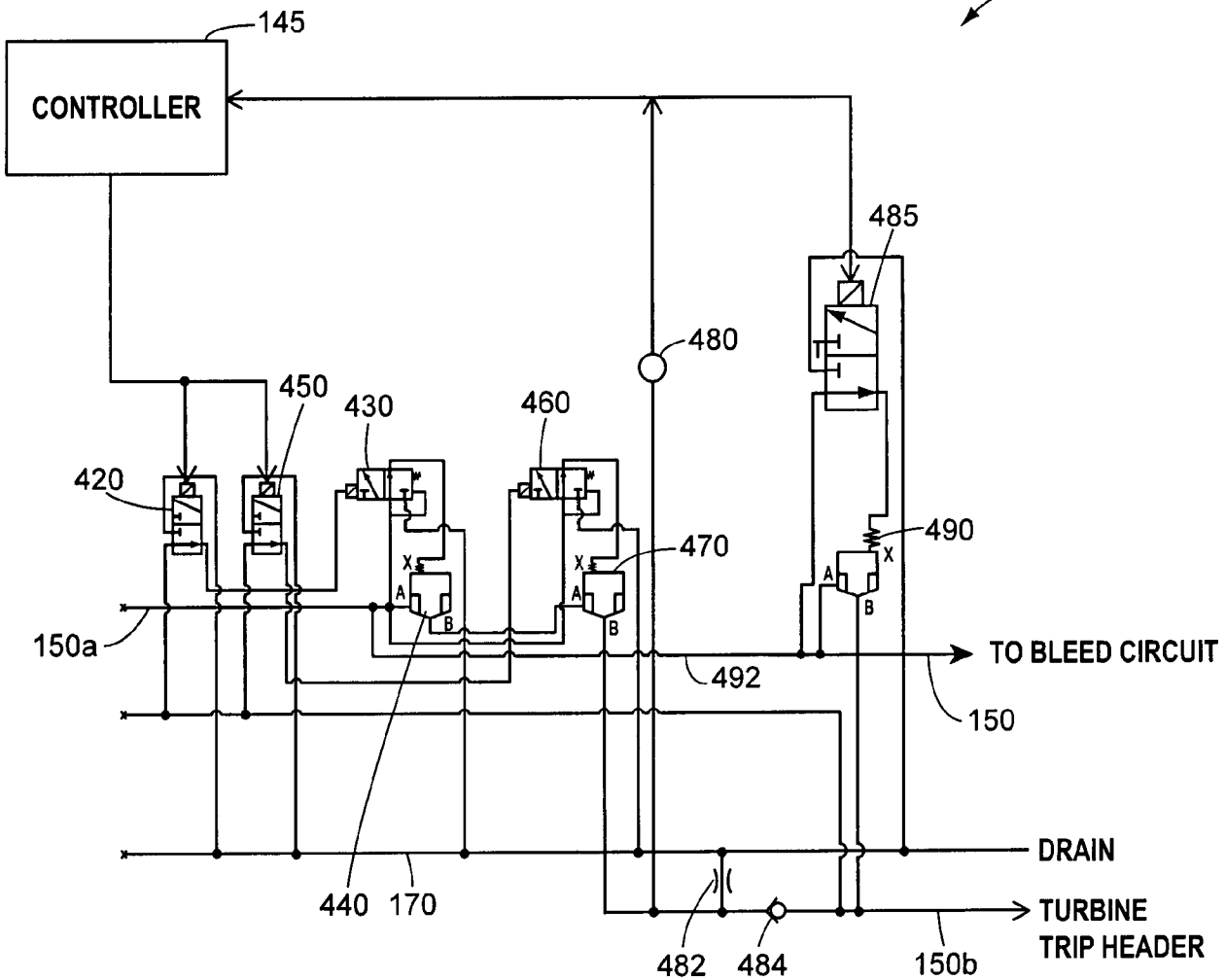
FIG. 5 is a more detailed schematic diagram of an embodiment of the block circuit shown in FIGS. 1 and 4.

FIG. 5 illustrates a schematic diagram depicting one possible configuration of the system of FIG. 4 in more detail. In particular, the first and second block actuators 420 and 450 are illustrated as solenoid driven pilot valves having a solenoid electrically connected to the controller 145 to control the flow of downstream system pressure from the line 150*b* to the control inputs of the block valves 430 and 460. The block valves 430 and 460 are hydraulically operated valves which, upon activation or deactivation by the control pressure from the pilot valves 420 and 450, connect the control input of the logic valves 440 and 470 to the system pressure line 150*a* or to the drain 170. During normal operating conditions, the controller 145 is configured to de-activate or de-energize the block actuators 420 and 450 to thereby cause the block actuators 420 and 450 to supply downstream system pressure (i.e., fluid in the line 150*b*) to the control inputs of the block valves 430 and 460. As will be understood, the application of system pressure to the control inputs of the block valves 430 and 460 overcomes the biasing force of the springs in the block valves 430 and 460 and connects the control ports (X) of the logic valves 440 and 470 to the drain line 170, which allows the logic valves 440 and 470 to open, thereby enabling hydraulic fluid in the supply line 150*a* to reach the supply line 150*b*.

During a trip operation, the controller 145 may energize the solenoid of both of the first block actuator 420 and the second block actuator 450 to thereby cause the logic valves 440 and 470 to close and block the fluid line 150*a* from the fluid line 150*b*. More particularly, when the first block actuator 420 is energized, system pressure is released or removed from the control input of the first block valve 430, which causes control pressure to be applied to the control input of the first logic valve 440, causing the logic valve 440 to move to the closed position to prevent or block the flow of hydraulic fluid between the line 150*a* and the line 150*b*. Similarly, when the second block actuator 450 is energized, system pressure is released or removed from the control input of the second block valve 460, which causes control pressure to be applied to the control input of the second logic valve 470, causing the logic valve 470 to move to the closed position to prevent or block the flow of hydraulic fluid from the line 150*a* to the line 150*b*.

Because the logic valves 440 and 470 of the first blocking system 400 and the second blocking system 410, respectively, are connected in series between the lines 150*a* and 150*b*, the block circuit 120 performs redundant blocking functions, thereby assuring high reliability. For example, if the first blocking system 400 fails to properly perform a blocking function due to, for example, the failure of one or more components associated with the first blocking system 400, the series-connected second blocking system 410 is configured to ensure that the blocking function is still performed to prevent or block the flow of hydraulic fluid from the hydraulic fluid source to the turbine trip header. Similarly, if the second blocking system 410 fails to properly perform a blocking function due to, for example, the failure of one or more components associated with the second blocking system 410, the series-connected first blocking system 400 is configured to ensure that the blocking function is still performed to prevent or block the flow of hydraulic fluid from the hydraulic fluid source to the turbine trip header. Accordingly, the block circuit 120 is configured such that only one of the first blocking system 400 and the second blocking system 410 is required to perform a blocking operation to block or prevent the flow of hydraulic fluid from the hydraulic fluid source to the turbine trip header.

Using the system depicted in FIGS. 4 and 5, it is possible to test the components associated with the block circuit 120 while the turbine 110 is operating without interrupting operation of the turbine 110. To this end, the block circuit 120 includes a pressure transmitter 480 configured to sense the pressure in the line 150*b* located downstream of the first and second blocking systems 400, 410 and upstream from the turbine trip header, an orifice 482 disposed between the line 150*b* and the drain line 170 (FIG. 5) and a check valve 484 (FIG. 5) disposed in the line 150*b*. By monitoring the pressure sensed by the pressure transmitter 480, the controller 145 may determine whether all of the components associated with the block circuit 120 are operating properly to perform a blocking operation. Specifically, the controller 145 may separately test the operation of the first blocking system 400 and the second blocking system 410 by energizing the first block actuator 420 and the second block actuator 450 one at a time, and monitoring the pressure sensed by the pressure transmitter 480 in the fluid line 150*b* located downstream of the first and second blocking systems 400, 410. As will be understood, while the controller 145 is testing the components associated with the block circuit 120, the controller 145 maintains the ability to stop operation of the turbine 110 (i.e., trip the turbine 110) when the controller 145 detects an abnormal condition or malfunction.

Referring to FIG. 5, to test the operation of the first blocking system 400 while the turbine 110 is operating, the controller 145 may energize the first block actuator 420 while keeping the second block actuator 450 de-energized. When the first block actuator 420 is energized and the second block actuator 450 is de-energized, downstream system pressure is released or removed from the control input of the first block valve 430 and the pressure at the control input of the first block valve 430 is diverted to the drain 170. As a result, the first block valve 430 opens immediately, which connects upstream control pressure or system pressure in the line 150*a* to the control port (X) of the first logic valve 440. This action, in turn, causes the first logic valve 440 to immediately move to the closed position. When the first logic valve 440 is in the closed position, the pressure in the line 150*b* located downstream of the first and second blocking systems 400, 410 and upstream from the check valve 484 begins to drop or decay due to the operation of the orifice 482 which slowly bleeds the pressure in the line 150*b* downstream of the valve 440 and upstream of the check valve 484 to the drain 170. In one embodiment, the orifice 482 may be sized to be approximately 0.031 inches in diameter, although other sizes may be used instead. As is typical, the check valve 484 operates as a one-way valve to keep the pressure in the line 150*b* downstream of the check valve 484 close to system pressure even though the pressure in the line 150*b*upstream of the check valve 484 begins to drop below system pressure.

If the pressure transmitter 480 senses a decrease in fluid pressure in the hydraulic fluid line 150*b* upstream of the check valve 484 after the first block actuator 420 is energized while keeping the second block actuator 450 de-energized, the controller 145 may determine that all of the components in the first blocking system 400 are operating properly. However, before the fluid pressure in the line 150*b* downstream of the check valve 484 decreases to a pressure that is sufficiently below the system pressure to trigger a trip operation (i.e., to close the steam valve 140 of FIG. 1) or too low to actuate the first block valve 430, the controller 145 de-energizes the first block actuator 420, which causes the first logic valve 440 to reopen and supply system pressure to the line 150*b*.

Similarly, to test the operation of the second blocking system 410 while the turbine 110 is operating, the controller 145 energizes the second block actuator 450 while keeping the first block actuator 420 de-energized. When the second block actuator 450 is energized and the first block actuator 420 is de-energized, system pressure is released or removed from the control input of the second block valve 460 and the pressure at the control input of the second block valve 460 is diverted to the drain 170. As a result of the loss of control pressure, the second block valve 460 actuates to apply the control pressure in the line 150*a* to the control port (X) of the second logic valve 470. This action, in turn, causes the second logic valve 470 to immediately move to the closed position. When the second logic valve 470 is in the closed position, the pressure in the line 150*b* upstream of the check valve 484 starts to decrease. Again, if the pressure transmitter 480 senses a proper or expected decrease in pressure in the line 150*b* upstream of the check valve 484, the controller 145 determines that all of the components in the second blocking branch 410 are operating properly. On the other hand, if the controller 145 does not detect a pressure decrease, one or more of the components of the valve system 410 may be faulty and in need of repair. However, before the pressure in the line 150*b* decreases to a pressure that is sufficiently below system pressure to trigger a trip of the steam valve 140 of FIG. 1 or too low to actuate the second block valve 460, the controller 145 de-energizes the first block actuator 420 which causes the second logic valve 470 to re-open. Of course, the controller 145 may send an alarm, an alert or any other signal to an operator, technician, etc. or take any other desired action upon detecting a fault in any of the components of the block circuit 120.

The block circuit 120 described above performs reliable electronically controlled redundant blocking functionality by providing redundant blocking systems 400, 410, the operation of only one of which is needed to perform a block function. Of course, it will be understood that the testing of the block functionality will typically be performed when no testing of the bleed functionality of the bleed circuit 130 is being performed, although it may be possible to test both of these system simultaneously. In any event, the controller 145 may still implement a trip of the turbine 110 while one of the blocking systems 400 or 410 is being tested, as the controller 145 needs to merely control two out of three of the bleed actuators 292, 293, and 294 to bleed the pressure from the line 150*b* to thereby cause an immediate trip of the turbine 110 in the manner discussed above, and this bleed function can take place while one of logic valves 440 or 470 is closed for testing purposes. In fact, such a bleed function can occur when one or both of the logic valves 440 and 470 are closed and blocking the line 150*a* from the line 150*b*. Thus, the testing of the block circuit 120 does not effect the ability of the controller 145 to engage a trip of the turbine 110.

In any event, after a trip operation has been performed to stop the operation of the turbine 110, and it is necessary to reset or start the turbine 110, it is first necessary to remove the blocking functionality provided by the block circuit 120 to thereby allow system pressure to be built up or re-established in the hydraulic fluid line 150*b*. However, using the blocking system illustrated in FIG. 5, system pressure must first exist in the downstream line 150*b* to enable the first and second logic valves 440 and 470 to open. As a result, once engaged after a trip, the block circuit 120 must be reset. One of the purposes of this reset configuration is to assure that a failure of the logic valves 440 and 470 or the controller 145 during a trip does not accidentally reengage the steam valve 140. To enable such a reset, the block circuit 120 of FIGS. 4 and 5 includes a reset actuator 485 and a reset logic valve 490 coupled within a reset bypass line 492 and having a control input (X) hydraulically coupled to the reset actuator 485. As illustrated in FIGS. 4 and 5, the reset actuator 485 is operatively coupled to the controller 145 and controls the operation of the reset logic valve 490 (which is a bypass valve that bypasses the first and second logic valves 440 and 470). In the embodiment depicted in FIG. 5, the reset actuator 485 includes a solenoid valve and the reset logic valve 490 is a two-way DIN cartridge valve having a pair of operational ports (A, B) and a control port (X). Hydraulic fluid passes through the operational ports (A, B) of the reset logic valve 490 in response to the absence of control pressure at the control port (X) to thereby allow fluid to flow from the line 150*a* to the line 150*b* even when one or both of the logic valves 440 and 470 are closed. Once system pressure is re-established in the line 150*b* (which can only occur after the bleed circuit 130 is set so as to eliminate any bleed paths between the line 150*b* and the return line 160), fluid pressure via the line 150*b* will increase through the first and second block actuators 420 and 450 causing the first and second block valves 430 and 460 to vent to the drain 170 and remove control pressure from the control inputs of the first and second logic valves 440 and 470, which causes these valves to reopen. Thereafter, the controller 145 can de-energize the reset actuator 485 which applies upstream system pressure to the control input of the reset logic valve 490 and causes the reset logic valve 490 to close, thereby closing the reset bypass line 492.

In one embodiment, the reset logic valve 490 is normally biased in a closed position by a spring (not shown) or other mechanical device to prevent or block the flow of hydraulic fluid from the hydraulic fluid source connected to the line 150*a* to the turbine trip header connected to the line 150*b*. The logic valve 490 normally allows free flow from ports (A) to (B) or (B) to (A). Because the port (X) on the logic valve 490 connects directly to the line 150*a* through the reset actuator 485, the logic valve 490 will not allow flow from port (A) to port (B) (i.e., from pressure line 150*a* to line 150*b*), unless the pressure at port (X) of the logic valve 490 is vented. When the reset actuator 485 receives a signal from the controller 145, it moves to its actuated position and connects its (B) port to the drain 170 which in turn connects port (X) of the logic valve 490 to the drain 170, thus allowing fluid flow from port (A) to port (B) on the logic valve 490, and on to the turbine trip header 150*b*. Thus, to reset the block circuit 120, the controller 145 is configured to energize the reset actuator 485 for enough time to re-establish system pressure in the line 150*b*, to open the first and second logic valves 440 and 470 via pressure flow through the first and second block actuators 420 and 450, and to then de-energize the reset actuator 485, which applies control pressure to the control port (X) of the reset logic valve 490, and connects the fluid in the line connected to the control port (X) of the reset logic valve 490 to the upstream pressure 150*a*. As a result, the reset logic valve 490 is moved to the closed position.

Figure 6:
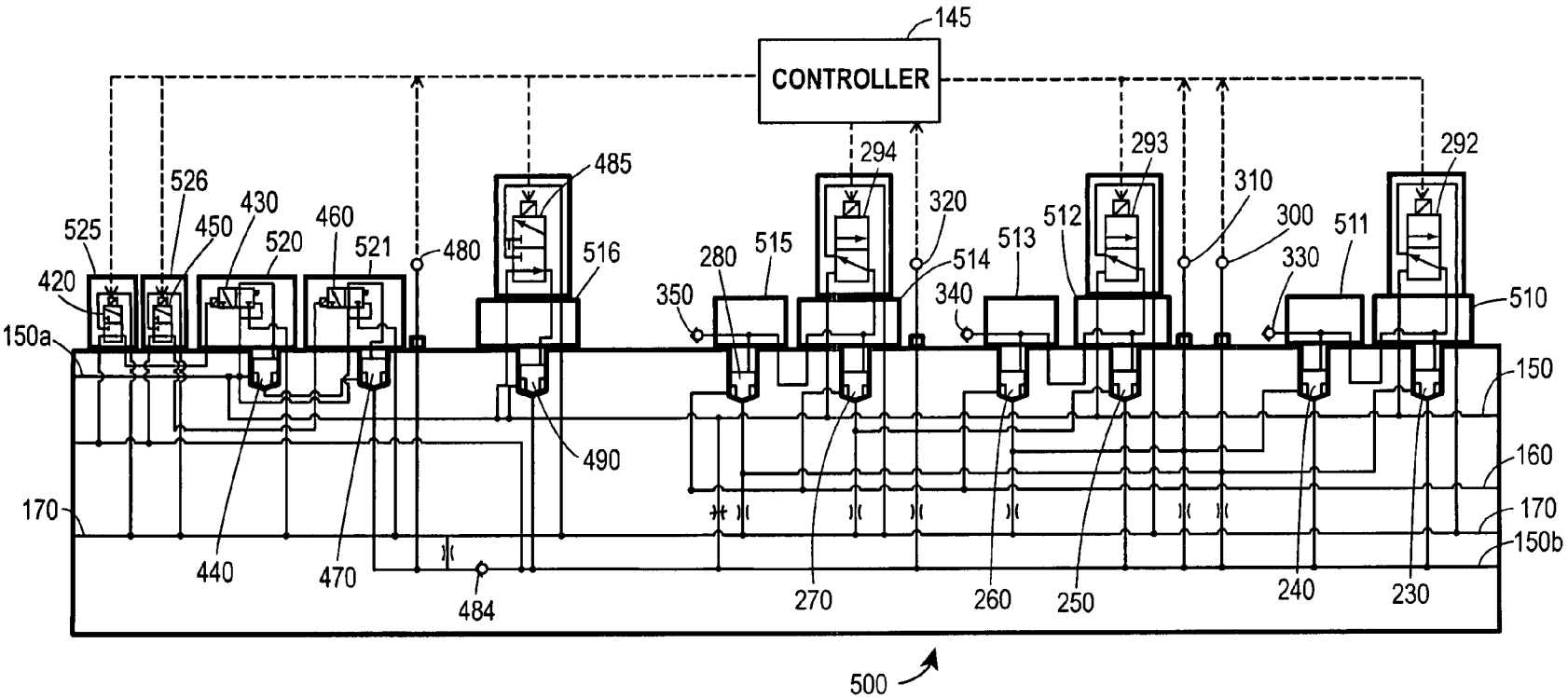
FIG. 6 is a detailed schematic diagram of a trip control circuit in which the bleed circuit and the block circuit of FIG.

FIG. 6 illustrates a schematic diagram of one embodiment of the block circuit 120 hydraulically coupled to the bleed circuit 130 as a single, integrated hydraulic assembly connected together as a single unit using a manifold 500, without a lot of piping or other components that are difficult to manufacture and install. As shown in the embodiment of FIG. 6, the single manifold block 500 may be used as a common platform to enable the block circuit 120 to be coupled to the bleed circuit 130 in series such that the supply pressure is ported through the manifold 500 to the valves and actuators associated with the block circuit 120 to arrive at the valves and actuators associated with the bleed circuit 130. It should be understood, however, that some of the components of the block circuit 120 and the bleed circuit 130 are connected in parallel such that the valves associated with both the block circuit 120 and the bleed circuit 130 share a common supply pressure for actuating these valves.

In any event, the schematic diagram of FIG. 6 essentially includes the diagrams of FIGS. 3 and 5 concatenated to form a single circuit, with the components of FIGS. 3 and 5 having the same reference numerals in FIG. 6. However, for the sake of clarity, some of the reference numerals shown in FIGS. 3 and 5 are omitted from FIG. 6. Still further, connections to the controller 145 are illustrated in FIG. 6 with dotted lines.

Now, with respect to FIG. 6, the fluid lines 150, 150*a*, 150*b*, 160 and 170, as well as the orifices 299*a*-299*c*, 301*a*-301*c* and 482 and the check valve 484 are all disposed or cut into the three-dimensional manifold 500 which may be made of, for example, aluminum or any other suitable material. The outline of the manifold 500 is illustrated with at thick solid line in FIG. 6 for the sake of clarity. As graphically depicted on the top portion of the manifold 500 of FIG. 6, the manifold 500 includes six cut-out sections which may be circular in cross section and cylindrical in shape and drilled into the same or different sizes of the manifold 500. Each of the cut-out sections is sized and shaped so that one of the DIN valves 230, 240, 250, 260, 270, 280, 440, 470 and 490 may be removably disposed in or mounted therein. Various cover plates 510-516 (the outlines of which are also shown with a thicker line in FIG. 6) are disposed over and removably mounted to the outside of the manifold 500 using, for example, threaded bolts or other attachment mechanisms and the cover plates 510-516 hold the DIN valves 230, 240, 250, 260, 270, 280, 470 and 490, in place with respect to the cut-out sections of the manifold 500. Still further the actuators 292, 293, 294 and 485 are removably mounted onto the cover plates 510, 512, 514 and 516, respectively to thereby be removably mounted to the manifold 500. As will be understood, the cover plates 510-516 include fluid passages there through to allow fluid within the manifold 500 to reach the actuators 292-294 and 485 and vise-versa. Thus, the cover plates 510-516 additionally operate or function as mechanical adaptors to removably mate the mounting hardware of the actuators 292-294 and 485 to the manifold 500. Still further, as depicted in FIG. 6, the DIN valves 440 and 470 may be held within their respective cut-out sections of the manifold 500 by mounting hardware 520 and 521 associated with the block valves 430 and 460 while the actuators 420 and 450 may be removably mounted directly to the manifold 500 via mounting hardware 525 and 526 associated with the actuators 420 and 450. The flow connections between the manifold 500 and the cover plates 510-516, and the mounting hardware 520, 521, 525 and 526 are illustrated in FIG. 6 as lines traveling though the boundaries of these devices. Similarly, the flow connections between the cover plates 510, 512, 514 and 516 and mounting hardware associated with the actuators 292, 293, 294 and 485 is illustrated in FIG. 6 as lines traveling through the boundaries of these devices. Likewise, each of the pressure sensor or pressure transmitters 300, 310, 320, 330, 340, 350 and 480 may be removably mounted to the manifold 500 using, for example, threaded holes in the manifold 500, mounting hardware on the pressure sensors that have holes therein which engage bolts sticking out of the side of the manifold 500, etc. Of course, it will be understood that the depictions of FIG. 6 are not meant to illustrate the exact three-dimensional design of the manifold 500 or the three-dimensional manner in which the cover plates 510-516 and the mounting hardware 520, 521, 525 and 526 are to be attached to the manifold 500, it being understood that different ones of the cut away sections of the manifold 500 may be in different sides of the manifold 500, that various ones of the cover plates 510-516, the actuators 292-294, 485, the hardware 520, 521, 525, 525 and the pressure sensors 300, 310, 320, 330, 340, 350, 480 may be on different sides of the manifold 500, etc.

Figure 7A:
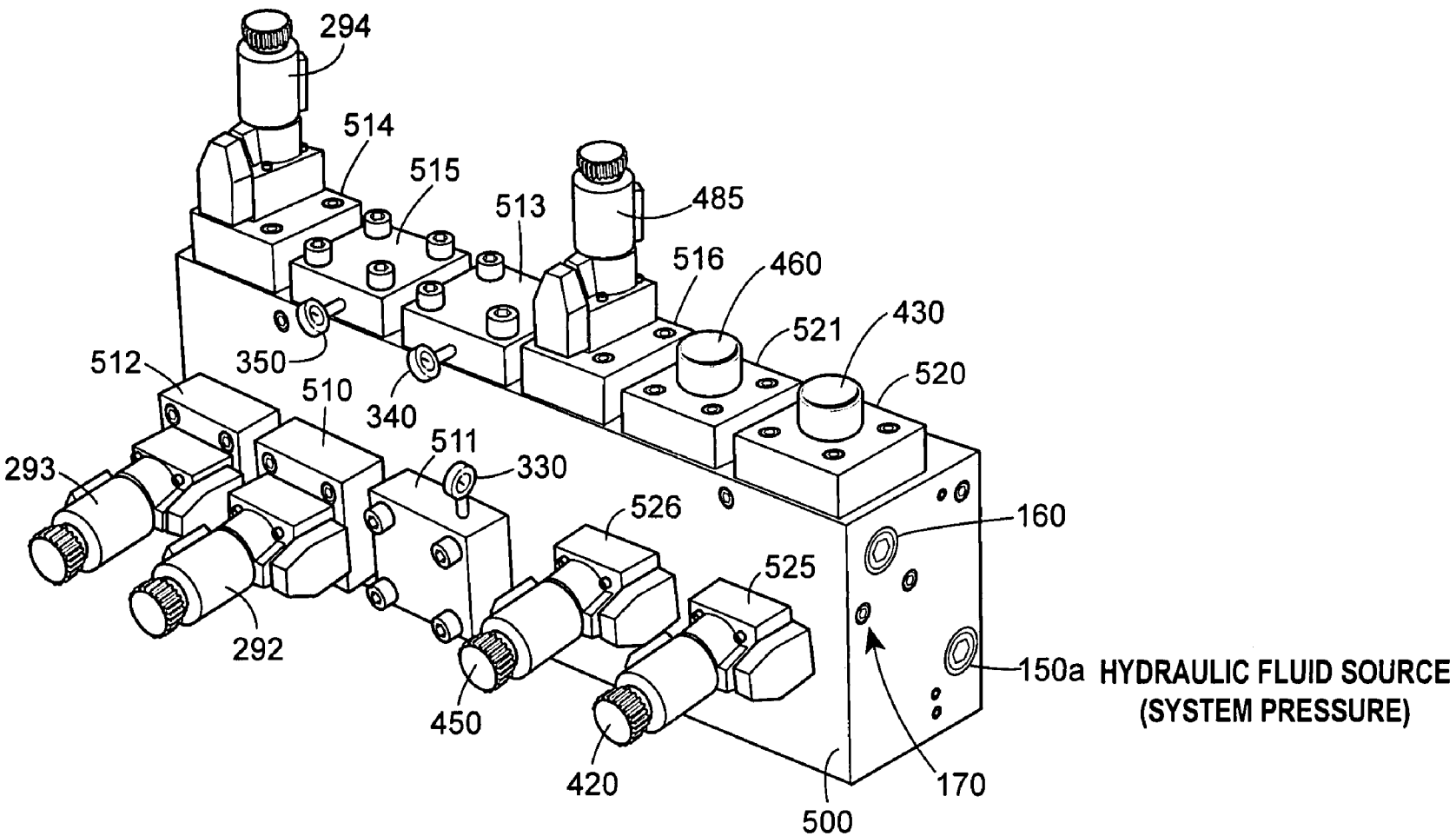
FIGS. 7A and 7B are three-dimensional perspective views of a manifold having various components of a bleed circuit and a block circuit removably mounted thereto to form an integrated trip circuit.
Figure 7B:
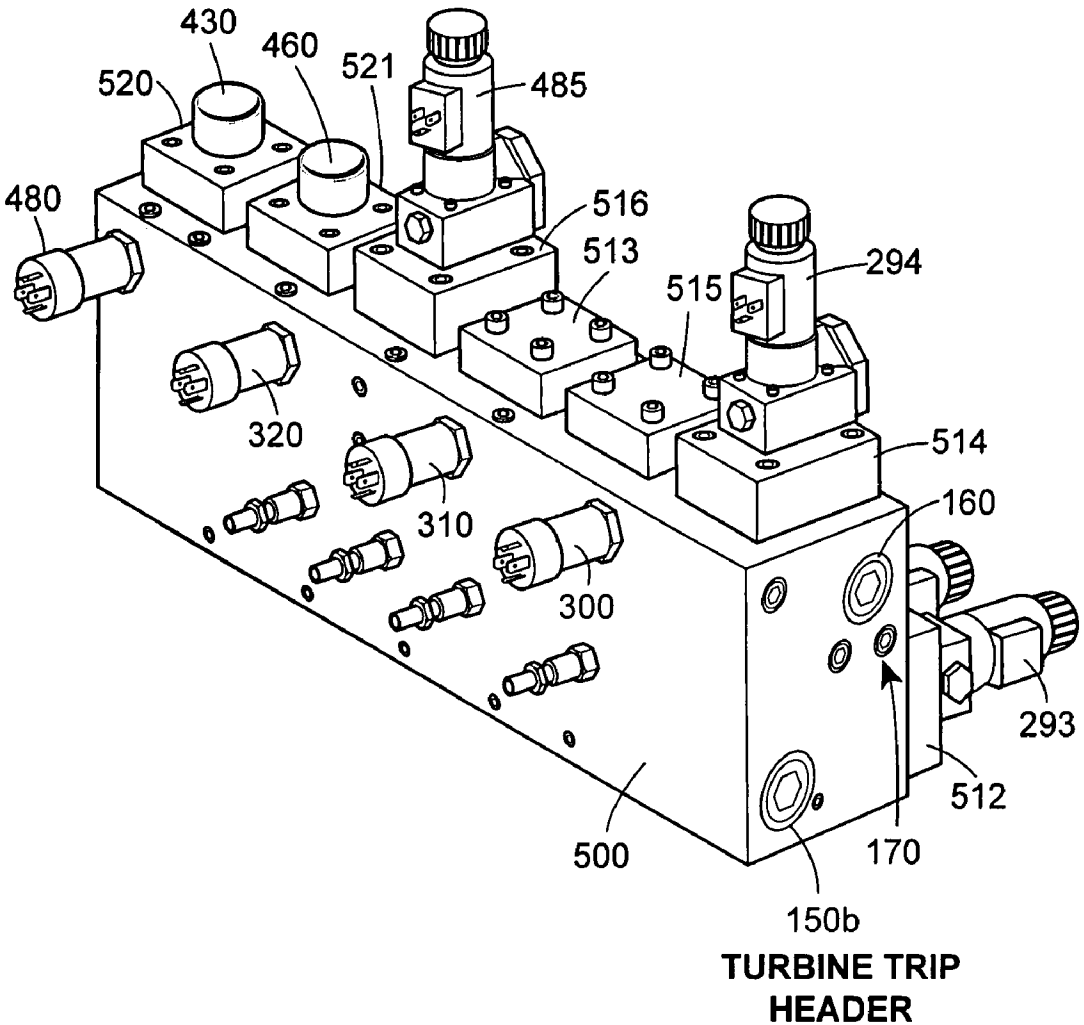

As an example, FIGS. 7A and 7B illustrate different three-dimensional perspective views of a manifold 500 having various ones of the cover plates 510-516, the mounting hardware 520, 521, 525 and 526, the actuators 292-294 and 485 and the pressure sensors 300, 310, 320, 330, 340, 350, 480 removably mounted thereto. Here, it will be understood that, while threaded bolts are used to removably mount the cover plates 510-516, the mounting hardware 520, 521, 525 and 526 and the actuators 292-294 and 485 to the manifold 500, any other desired attachment structure could be used as well or instead. Thus, as illustrated in FIGS. 7A and 7B, each of the components associated with the block circuit 120 and the bleed circuit 130 may be integrally assembled and connected to each other using a three-dimensional manifold block or other fluid distribution device having one or more portals, passages, and chambers therein. In this manner, the size of the tripping control system 100 may be reduced due to the elimination or reduction in piping and other connectors. Alternatively, the components associated with the block circuit 120 and the bleed circuit 130 may be mounted to bases or subplates that are piped together.

It should be understood that the tripping control system 100, as described above, may be retrofitted with existing mechanical hydraulic control (MHC) turbines by, for example, removing the emergency trip valve, associated linkages and other components, and inserting the tripping control system 100 in the hydraulic fluid path 150. Still further, it will be understood that, while the valves, actuators and other components have been variously described as being electronically or hydraulically controlled components biased to particular normally open or closed positions, individual ones of these actuators and valves could be electronically or hydraulically controlled in a manner other than described herein and may be biased in other manners then those described herein. Still further, in some cases, various ones of the valves or actuator may be eliminated or the functionality may be combined into a single valve device. Thus, for example, it may be possible to eliminate the first and second block valves 430 and 460 and connect the actuators 420 and 450 directly to the valves 440 and 470. Likewise, it may be possible to integrate the actuators 420 and 450 onto or with the block valves 430 and 460 or even with the valves 440 and 470 so that a single valve is used in each of the block valve systems 400 and 410. Still further, it will be understood that the controller 145 described herein includes one or more processors and a computer readable memory which stores one or more programs for performing the tripping, testing and monitoring functions described herein. When implemented, the programs may be stored in any computer readable memory such as on a magnetic disk, a laser disk, or other storage medium, in a RAM or ROM of a computer or processor, as part of an application specific integrated circuit, etc. Likewise, this software may be delivered to a user, a process plant, a controller, etc. using any known or desired delivery method including, for example, on a computer readable disk or other transportable computer storage mechanism or over a communication channel such as a telephone line, the Internet, the World Wide Web, any other local area network or wide area network, etc. (which delivery is viewed as being the same as or interchangeable with providing such software via a transportable storage medium). Furthermore, this software may be provided directly without modulation or encryption or may be modulated and/or encrypted using any suitable modulation carrier wave and/or encryption technique before being transmitted over a communication channel.

While the present disclosure has been described with reference to specific examples, which are intended to be illustrative only and not to be limiting of the disclosure, it will be apparent to those of ordinary skill in the art that changes, additions, or deletions may be made to the disclosed embodiments without departing from the spirit and scope of the disclosure.

What is claimed is:

1. A trip control system for controlling the operation of a controlled device using fluid pressure delivered from a fluid pressure source to an input of the controlled device, comprising:

a fluid pressure line adapted to be connected between the fluid pressure source and the input of the controlled device, the input of the controlled device being a control input that controls the controlled device to move between a first state and a second state when a pressure at the input exceeds a certain amount, wherein the first state is one of an opened or a closed state, and the second state is the other of the opened or the closed state;

a low pressure fluid return line;

a bleed circuit having a bleed valve system hydraulically and directly coupled between the fluid pressure line and the low pressure fluid return line, the bleed circuit disposed upstream of the input of the controlled device and the bleed valve system operable to hydraulically and controllably connect the fluid pressure line to the low pressure fluid return line to reduce the fluid pressure within the fluid pressure line; and a block circuit disposed at least partially in the fluid pressure line upstream of the bleed circuit and coupled to the low pressure fluid return line, the block circuit including:

a first valve and a second valve disposed in series in the fluid pressure line, the first and the second valve each operable to completely block the fluid pressure line; and first and second electronically controlled actuators hydraulically coupled to the first and second valves to control the operation of the first and second valves, the first and second electronically controlled actuators adapted to receive control signals to control the operation of the first and second valves.

2. The trip control system of claim 1, further including a pressure sensor disposed to sense pressure in the fluid pressure line downstream of the first and second valves.

3. A trip control system for controlling the operation of a controlled device using fluid pressure delivered from a fluid pressure source, comprising:

a fluid pressure line adapted to be connected between the fluid pressure source and the controlled device;

a low pressure fluid return line;

a bleed circuit having a bleed valve system hydraulically coupled between the fluid pressure line and the low pressure fluid return line, the bleed valve system operable to hydraulically and controllably connect the fluid pressure line to the low pressure fluid return line to reduce the fluid pressure within the fluid pressure line; and a block circuit including:

a first valve and a second valve disposed in series in the fluid pressure line upstream of the bleed circuit;

first and second electronically controlled actuators hydraulically coupled to the first and second valves to control the operation of the first and second valves, the first and second electronically controlled actuators adapted to receive control signals to control the operation of the first and second valves; and a first intermediate control valve hydraulically coupled between the first valve and the first electronically controlled actuator, and a second intermediate control valve hydraulically coupled between the second valve and the second electronically controlled actuator, wherein each of the first and second intermediate control valves includes a control input and a first hydraulic output and each of the first and second valves includes a control input, wherein the first electronically controlled actuator includes a hydraulic output coupled to the control input of the first intermediate control valve and the first hydraulic output of the first intermediate control valve is coupled to the control input of the first valve, and wherein the second electronically controlled actuator includes a hydraulic output coupled to the control input of the second intermediate control valve and the first hydraulic output of the second intermediate control valve is coupled to the control input of the second valve.

4. The trip control system of claim 3, wherein each of the first and second intermediate control valves includes a second hydraulic output coupled to a fluid drain, and wherein actuation of one of the first or second intermediate control valves causes a change of a connection of the first hydraulic output of the one of the first or second intermediate control valves between the fluid pressure line and the second hydraulic output of the one of the first or second intermediate control valves.

5. The trip control system of claim 3, wherein each of the first and second electronically controlled actuators includes a hydraulic input coupled to the fluid pressure line.

6. The trip control system of claim 5, wherein at least one of the hydraulic inputs of the first and second electronically controlled actuators is coupled to the fluid pressure line downstream of the first and second valves.

7. The trip control system of claim 3, wherein each of the first and second intermediate control valves includes a hydraulic input coupled to the fluid pressure line.

8. The trip control system of claim 7, wherein at least one of the hydraulic inputs of the first and second intermediate control valves is coupled to the fluid pressure line upstream of the first and second valves.

9. A trip control system for controlling the operation of a controlled device using fluid pressure delivered from a fluid pressure source, comprising:

a fluid pressure line adapted to be connected between the fluid pressure source and the controlled device;

a low pressure fluid return line;

a bleed circuit having a bleed valve system hydraulically coupled between the fluid pressure line and the low pressure fluid return line, the bleed valve system operable to hydraulically and controllably connect the fluid pressure line to the low pressure fluid return line to reduce the fluid pressure within the fluid pressure line;

a block circuit including:

a first valve and a second valve disposed in series in the fluid pressure line upstream of the bleed circuit; and first and second electronically controlled actuators hydraulically coupled to the first and second valves to control the operation of the first and second valves, the first and second electronically controlled actuators adapted to receive control signals to control the operation of the first and second valves;

a pressure sensor disposed to sense pressure in the fluid pressure line downstream of the first and second valves; and an orifice disposed between the fluid pressure line and a low pressure fluid path, the orifice located in the fluid pressure line downstream of the first and second valves to enable fluid within the fluid pressure line to exit the fluid pressure line via the orifice at a rate that is less than the rate at which fluid is able to flow through the fluid pressure line.

10. The trip control system of claim 9, further including a one way valve disposed within the fluid pressure line downstream of the orifice.

11. A trip control system for controlling the operation of a controlled device using fluid pressure delivered from a fluid pressure source to a trip input of the controlled device, comprising:

a fluid pressure line adapted to be connected between the fluid pressure source and the trip input of the controlled device;

a low pressure fluid return line;

a bleed circuit having a bleed valve system hydraulically coupled between the fluid pressure line and the low pressure fluid return line, the bleed circuit disposed upstream of the trip input of the controlled device and the bleed valve system operable to hydraulically and controllably connect the fluid pressure line to the low pressure fluid return line to reduce the fluid pressure within the fluid pressure line; and a block circuit, including:

a first valve and a second valve disposed in series in the fluid pressure line upstream of the bleed circuit, the first and the second valve each operable to completely block the fluid pressure line;

first and second electronically controlled actuators hydraulically coupled to the first and second valves to control the operation of the first and second valves, the first and second electronically controlled actuators adapted to receive control signals to control the operation of the first and second valves, and a reset valve having a reset valve input coupled to the fluid pressure line upstream of the first and second valves and a reset valve outlet coupled to the fluid pressure line downstream of the first and second valves, wherein the reset valve, when in an open position, produces a bypass path in the fluid pressure line around the first and second valves.

12. The trip control system of claim 11, further including an electronically controlled reset actuator coupled to the reset valve and adapted to open the reset valve in response to an electronic reset signal.

13. The trip control system of claim 12, wherein the reset valve includes a reset control input, and wherein the reset actuator includes a reset actuator fluid input hydraulically coupled to the fluid pressure line upstream of the first and second valves and a reset actuator fluid output hydraulically coupled to the reset control input of the reset valve.

14. A trip control system for controlling the operation of a controlled device using fluid pressure delivered from a fluid pressure source to a trip input of the controlled device, comprising:

a fluid pressure line adapted to be connected between the fluid pressure source and the trip input of the controlled device;

a low pressure fluid return line;

a bleed circuit having a bleed valve system hydraulically coupled between the fluid pressure line and the low pressure fluid return line, the bleed circuit disposed upstream of the trip input of the controlled device and the bleed valve system operable to hydraulically and controllably connect the fluid pressure line to the low pressure fluid return line to reduce the fluid pressure within the fluid pressure line; and a block circuit including:

a first valve and a second valve disposed in series in the fluid pressure line upstream of the bleed circuit, the first and the second valve each operable to completely block the fluid pressure line;

first and second electronically controlled actuators hydraulically coupled to the first and second valves to control the operation of the first and second valves, the first and second electronically controlled actuators adapted to receive control signals to control the operation of the first and second valves, wherein the first electronically controlled actuator includes a first hydraulic output coupled to control the first valve, and a second hydraulic output hydraulically coupled to a low pressure line, and the second electronically controlled actuator includes a first hydraulic output coupled to control the second valve, and a second hydraulic output hydraulically coupled to the low pressure line, and wherein actuation of one of the first or second electronically controlled actuators causes a change of a connection of the first hydraulic output of the one of the first or second electronically controlled actuators between the fluid pressure line and the second hydraulic output of the one of the first or second electronically controlled actuators.

15. A trip control system, comprising:

a controller including a processor and a computer readable memory;

a fluid pressure line adapted to be connected between a fluid pressure source and an input of a controlled device, the input of the controlled device being a control input that controls the controlled device to move between a first state and a second state when a pressure at the input exceeds a certain amount, wherein the first state is one of an opened or a closed state, and the second state is the other of the opened or the closed state;

a low pressure fluid return line;

a bleed circuit having a bleed valve system directly coupled between the fluid pressure line and the low pressure fluid return line, the bleed circuit disposed upstream of the input of the controlled device and the bleed valve system operable to hydraulically and controllably connect the fluid pressure line to the low pressure fluid return line to reduce the fluid pressure within the fluid pressure line at the input of the controlled device; and a block circuit disposed at least partially in the fluid pressure line upstream of the bleed circuit and coupled to the low pressure fluid return line, the block circuit including:

a first valve and a second valve disposed in series in the fluid pressure line, the first and second valves being coupled to the controller and controlled by the controller to control the flow of fluid through the fluid pressure line to the input of the controlled device.

16. The trip control system of claim 15, wherein the first and second valves are hydraulically actuated valves and wherein block circuit further includes a first electronically controlled actuator electronically coupled to the controller and hydraulically coupled to the first valve to hydraulically control the operation of the first valve based on one or more electronic signals from the controller and a second electronically controlled actuator electronically coupled to the controller and hydraulically coupled to the second valve to hydraulically control the operation of the second valve based on one or more electronic signals from the controller.

17. The trip control system of claim 15, further including a pressure sensor disposed to sense pressure in the fluid pressure line downstream of the first and second valves, the pressure sensor electronically connected to the controller.

18. A trip control system comprising:

a controller including a processor and a computer readable memory;

a fluid pressure line adapted to be connected between a fluid pressure source and a controlled device;

a low pressure fluid return line;

a bleed circuit having a bleed valve system disposed between the fluid pressure line and the low pressure fluid return line, the bleed valve system operable to hydraulically and controllably connect the fluid pressure line to the low pressure fluid return line to reduce the fluid pressure within the fluid pressure line at the controlled device; and a block circuit including:

a first valve and a second valve disposed in series in the fluid pressure line upstream of the bleed circuit, the first and second valves being coupled to the controller and controlled by the controller to control the flow of fluid through the fluid pressure line, wherein the first and second valves are hydraulically actuated valves and wherein block circuit further includes:

a first electronically controlled actuator electronically coupled to the controller and hydraulically coupled to the first valve to hydraulically control the operation of the first valve based on one or more electronic signals from the controller and a second electronically controlled actuator electronically coupled to the controller and hydraulically coupled to the second valve to hydraulically control the operation of the second valve based on one or more electronic signals from the controller, and a first intermediate control valve hydraulically coupled between the first valve and the first electronically controlled actuator, and a second intermediate control valve hydraulically coupled between the second valve and the second electronically controlled actuator, wherein each of the first and second intermediate control valves includes a control input and a first hydraulic output and each of the first and second valves includes a control input, wherein the first electronically controlled actuator includes a hydraulic output coupled to the control input of the first intermediate control valve and the first hydraulic output of the first intermediate control valve is coupled to the control input of the first valve, and wherein the second electronically controlled actuator includes a hydraulic output coupled to the control input of the second intermediate control valve and the first hydraulic output of the second intermediate control valve is coupled to the control input of the second valve.

19. The trip control system of claim 18, wherein each of the first and second intermediate control valves includes a second hydraulic output coupled to a low pressure fluid drain, and wherein actuation of one of the first or second intermediate control valves causes a change of a connection of the first hydraulic output of the one of the first or second intermediate control valves between the fluid pressure line and the second hydraulic output of the one of the first or second intermediate control valves.

20. The trip control system of claim 18, wherein each of the first and second electronically controlled actuators includes a hydraulic input coupled to the fluid pressure line.

21. The trip control system of claim 20, wherein at least one of the hydraulic inputs of the first and second electronically controlled actuators is coupled to the fluid pressure line downstream of the first and second valves.

22. The trip control system of claim 21, wherein each of the first and second intermediate control valves includes a hydraulic input coupled to the fluid pressure line upstream of the first and second valves.

23. A trip control system comprising:

a controller including a processor and a computer readable memory;

a fluid pressure line adapted to be connected between a fluid pressure source and a controlled device;

a low pressure fluid return line;

a bleed circuit having a bleed valve system disposed between the fluid pressure line and the low pressure fluid return line, the bleed valve system operable to hydraulically and controllably connect the fluid pressure line to the low pressure fluid return line to reduce the fluid pressure within the fluid pressure line at the controlled device;

a block circuit including:

a first valve and a second valve disposed in series in the fluid pressure line upstream of the bleed circuit, the first and second valves being coupled to the controller and controlled by the controller to control the flow of fluid through the fluid pressure line;

a pressure sensor disposed to sense pressure in the fluid pressure line downstream of the first and second valves, the pressure sensor electronically connected to the controller; and an orifice disposed between the fluid pressure line and a low pressure line, the orifice located in the fluid pressure line downstream of the first and second valves to enable fluid within the fluid pressure line to slowly exit the fluid pressure line via the orifice.

24. The trip control system of claim 23, further including a one way valve disposed within the fluid pressure line downstream of the orifice.

25. The trip control system of claim 23, further including a test program stored in the computer readable memory and adapted to be executed on the processor of the controller to send an actuation signal to actuate one of the first or second valves and to use one or more signals from the pressure sensor to detect a drop in pressure in the pressure line downstream of the first and second valves.

26. The trip control system of claim 25, wherein the test program is adapted to determine correct operation of the one of the first and second valves upon detecting a pressure drop of a particular amount in a predetermined amount of time.

27. A trip control system, comprising:

a controller including a processor and a computer readable memory;

a fluid pressure line adapted to be connected between a fluid pressure source and a trip input of a controlled device;

a low pressure fluid return line;

a bleed circuit having a bleed valve system disposed between the fluid pressure line and the low pressure fluid return line, the bleed circuit disposed upstream of the trip input of the controlled device and the bleed valve system operable to hydraulically and controllably connect the fluid pressure line to the low pressure fluid return line to reduce the fluid pressure within the fluid pressure line at the trip input of the controlled device;

a block circuit including a first valve and a second valve disposed in series in the fluid pressure line upstream of the bleed circuit, the first and second valves being coupled to the controller and controlled by the controller to control the flow of fluid through the fluid pressure line to the trip input of the controlled device; and a reset valve having an input coupled to the fluid pressure line upstream of the first and second valves and an outlet coupled to the fluid pressure line downstream of the first and second valves, wherein the reset valve, when in an open position, produces a bypass path in the fluid pressure line around the first and second valves.

28. The trip control system of claim 27, further including an electronically controlled reset actuator hydraulically coupled to the reset valve and electronically coupled to the controller and adapted to open the reset valve in response to a reset electronic control signal from the controller.

29. The trip control system of claim 28, wherein the reset valve includes a hydraulic control input, and wherein the reset actuator includes a reset actuator fluid input coupled to the fluid pressure line upstream of the first and second valves and a reset actuator fluid output coupled to the hydraulic control input of the reset valve.

30. A trip control system comprising:

a controller including a processor and a computer readable memory;

a fluid pressure line adapted to be connected between a fluid pressure source and a controlled device;

a low pressure fluid return line;

a block circuit including a first valve and a second valve disposed in series in the fluid pressure line, the first and second valves being coupled to the controller and controlled by the controller to control the flow of fluid through the fluid pressure line; and a bleed circuit having a bleed valve system disposed between the fluid pressure line and the low pressure fluid return line, the bleed valve system operable to hydraulically and controllably connect the fluid pressure line to the low pressure fluid return line to reduce the fluid pressure within the fluid pressure line at the controlled device, wherein:

the first valve and the second valve of the block circuit are disposed in series in the fluid pressure line upstream of the bleed circuit, the bleed circuit includes redundant bleed valve systems disposed between the fluid pressure line and the low pressure fluid return line, each of the redundant bleed valve systems having one or more bleed valves and a bleed pressure sensor, the block circuit includes a block pressure sensor, wherein each of the bleed pressure sensors and the block pressure sensor is communicatively connected to the controller, and the controller includes a first test program which, when implemented on the processor of the controller, sends one or more first control signals to the bleed circuit to control one of the bleed valves within the bleed circuit to test the operation of the one of the bleed valves during operation of the controlled device and a second test program which, when implemented on the processor of the controller, sends a second control signal to the block circuit to control one of the first or second valves within the block circuit to test the operation of the one of the first or second valves during operation of the controlled device.

31. The trip control system of clam 30, wherein the first test program uses a measurement of at least one of the bleed pressure sensors to determine whether the one of the bleed valves operates properly and the second test program uses a measurement of the block pressure sensor to determine whether the one of the first or second valves operates properly.

32. An integrated trip system, comprising:

a manifold having a fluid pressure input adapted to be connected to a fluid pressure source and a fluid pressure output adapted to be connected to a controlled device;

a fluid pressure line disposed within the manifold between the fluid pressure input and the fluid pressure output, the fluid pressure line having a first section coupled to the fluid pressure input and a second section coupled to the fluid pressure output;

a low pressure fluid return line disposed within the manifold;

an electronically controlled bleed circuit including a plurality of bleed valve systems, each bleed valve system having one or more bleed valves removably mounted to the manifold, an input coupled to the second section of the fluid pressure line and an output connected to the low pressure fluid return line to controllably connect the second section of the fluid pressure line and the low pressure fluid return line, and a bleed pressure sensor removably mounted to the manifold to sense pressure associated with the bleed valve system; and a block valve circuit including, two electronically controlled block valve systems, each of the electronically controlled block valve systems including a block valve removably mounted to the manifold and disposed in the first section of the fluid pressure line to controllably block fluid flow from the first section of the fluid pressure line to the second section of the fluid pressure line, the block valves disposed in series with one another; and a block pressure sensor removably mounted to the manifold to sense pressure in the fluid pressure line downstream of the block valves.

33. The integrated trip system of claim 32, wherein each of the two electronically controlled block valve systems includes an electronically controlled actuator removably mounted to the manifold, each electronically controlled actuator having an electrical input adapted to be communicatively connected to an electronic control device and a hydraulic output adapted to hydraulically control one of the block valves.

34. The integrated trip system of claim 33, wherein each of the two electronically controlled block valve systems further includes an intermediate control valve having a control input hydraulically connected to one of the electronically controlled actuators and having a hydraulic output hydraulically connected to one of the block valves.

35. The integrated trip system of claim 34, wherein each of the electronically controlled actuators includes a hydraulic input coupled to the fluid pressure line through the manifold and each of the intermediate control valves includes a hydraulic input coupled to the fluid pressure line through the manifold.

36. The integrated trip system of claim 35, wherein the hydraulic input of each of the electronically controlled actuators is connected to the second section of the fluid pressure line and each of the hydraulic inputs of the intermediate control valves is coupled to the first section of the fluid pressure line.

37. The integrated trip system of claim 35, wherein the manifold further includes a low pressure drain line disposed therein and wherein each of the electronically controlled actuators includes a further output coupled to the low pressure drain line through the manifold, wherein actuation of one of the electronically controlled actuators connects the control input of one of the intermediate control valves to one of the fluid pressure line or to the low pressure drain line.

38. The integrated trip system of claim 35, wherein the manifold further includes a low pressure drain line disposed therein and wherein each of the intermediate control valves includes a further output coupled to the low pressure drain line through the manifold, wherein actuation of the intermediate control valves connects one of the block valves to one of the fluid pressure line or to the low pressure drain line.

39. The integrated trip system of claim 32, further including an additional low pressure fluid path disposed in the manifold and an orifice disposed between the fluid pressure line and the additional low pressure fluid path, the orifice located in the fluid pressure line downstream of the block valves to enable fluid within the fluid pressure line to slowly exit the fluid pressure line via the orifice.

40. The integrated trip system of claim 39, further including a one way valve disposed within the fluid pressure line downstream of the orifice.

41. The integrated trip system of claim 32, further including an electronically controlled reset valve system having a reset valve removably mounted to the manifold, the reset valve having a reset valve input coupled to the first section of the fluid pressure line through the manifold and a reset valve outlet coupled to the fluid pressure line downstream of the block valves through the manifold, wherein the reset valve, when in an open position, produces a bypass path in the fluid pressure line around the block valves.

42. The integrated trip system of claim 41, wherein the electronically controlled reset valve system includes an electronically controlled reset actuator removably mounted to the manifold and hydraulically coupled to the reset valve through the manifold and adapted to open the reset valve in response to an electronic control signal.

43. The integrated trip system of claim 42, wherein the reset valve includes a hydraulic reset control input, and wherein the reset actuator includes a reset actuator fluid input coupled to the first section of the fluid pressure line upstream of the block valves and a reset actuator fluid output coupled to the hydraulic reset control input of the reset valve.

44. The integrated trip system of claim 32, wherein each of the bleed valve systems includes two bleed valves removably mounted within the manifold and hydraulically connected in series with each other through the manifold, the electronically controlled bleed circuit further including two or more electronically controlled bleed actuators removably mounted to the manifold and coupled to the bleed valves to control the operation of the bleed valves.

45. The integrated trip system of claim 44, wherein a first one of the two or more electronically controlled bleed actuators is hydraulically connected to first and second ones of the bleed valves, to simultaneously control the operation of the first and second ones of the bleed valves, wherein the first one of the bleed valves is associated with a first one of the bleed valve systems and the second one of the bleed valves is associated with a second one of the bleed valve systems different than the first one of the bleed valve systems.

* * * * *

UNITED STATES PATENT AND TRADEMARK OFFICE

CERTIFICATE OF CORRECTION

PATENT NO. : 7,874,241 B2
APPLICATION NO. : 11/108930
DATED : January 25, 2011
INVENTOR(S) : Richard Peter Natili, Jr. et al.

It is certified that error appears in the above-identified patent and that said Letters Patent is hereby corrected as shown below:

In the Specification:

At Column 7, line 28, "then" should be -- than --.

At Column 21, line 15, "vise-versa" should be -- vice versa --.

Signed and Sealed this
Second Day of August, 2011

David J. Kappos

David J. Kappos
*Director of the United States Patent and Trademark Office*